US007277073B2

(12) United States Patent
Hattori

(10) Patent No.: US 7,277,073 B2
(45) Date of Patent: Oct. 2, 2007

(54) DRIVING DEVICE, DISPLAY APPARATUS USING THE SAME, AND DRIVING METHOD THEREFOR

(75) Inventor: Reiji Hattori, 200-1-109, Meihamamachi, Nishi-ku, Fukuoka-shi, Fukuoka 819-0004 (JP)

(73) Assignees: Casio Computer Co., Ltd., Tokyo (JP); Reiji Hattori, Fukuoka-shi (JP)

( * ) Notice: Subject to any disclaimer, the term of this patent is extended or adjusted under 35 U.S.C. 154(b) by 286 days.

(21) Appl. No.: 10/821,480

(22) Filed: Apr. 8, 2004

(65) Prior Publication Data

US 2004/0196275 A1 Oct. 7, 2004

Related U.S. Application Data

(63) Continuation of application No. PCT/JP03/008670, filed on Jul. 8, 2003.

(30) Foreign Application Priority Data

Jul. 9, 2002 (JP) ..... 2002-199730

(51) Int. Cl.
*G09G 3/30* (2006.01)
*G09G 3/32* (2006.01)
*G09G 3/10* (2006.01)

(52) U.S. Cl. ..... 345/77; 345/82; 315/169.3

(58) Field of Classification Search ..... 345/76–84; 315/169.1–169.3

See application file for complete search history.

(56) References Cited

U.S. PATENT DOCUMENTS 5,723,950 A * 3/1998 Wei et al. ..... 315/169.3
6,191,534 B1 * 2/2001 Schuler et al. ..... 315/169.3
6,246,384 B1 * 6/2001 Sano ..... 345/76

(Continued)

FOREIGN PATENT DOCUMENTS

CN 1327223 A 12/2001

(Continued)

OTHER PUBLICATIONS

Young-Sun NA et al ; "1.8-Inch Full-Color OEL Display for IMT2000 Terminals"; SID International Synposium Digest of Technical Papers, Boston, Mass. May 21-23, 2002., vol. 33, No. 2, May 2002; pp. 1178-1181.

*Primary Examiner*—Richard Hjerpe
*Assistant Examiner*—M. Fatahiyar
(74) *Attorney, Agent, or Firm*—Frishauf, Holtz, Goodman & Chick, P.C.

(57) ABSTRACT

A driving device which supplies a current to a plurality of current-driven optical elements to drive the optical elements includes at least a driving current supply circuit which supplies a driving current to each optical element for a predetermined period, and a control voltage applying circuit which applies a charge voltage having a voltage value corresponding to a voltage to be applied to each optical element using the driving current, before the driving current is supplied. The driving current supply circuit includes a single constant current generating circuit which outputs a constant current having the same current value as that of a driving current, and a plurality of current storage circuits which sequentially receive and hold the constant current and output the driving current on the basis of the constant current.

51 Claims, 15 Drawing Sheets

U.S. PATENT DOCUMENTS

| | | | | |
|---|---|---|---|---|
| 6,323,631 | B1 * | 11/2001 | Juang | 323/315 |
| 6,369,786 | B1 | 4/2002 | Suzuki | |
| 6,473,064 | B1 | 10/2002 | Tsuchida et al. | |
| 6,587,087 | B1 | 7/2003 | Ishizuka | |
| 6,608,620 | B1 * | 8/2003 | Suzuki et al. | 345/204 |
| 6,885,356 | B2 * | 4/2005 | Hashimoto | 345/77 |
| 2003/0006713 | A1 * | 1/2003 | Kim et al. | 315/169.2 |

FOREIGN PATENT DOCUMENTS

| | | | |
|---|---|---|---|
| EP | 1 071 070 | A2 | 1/2001 |
| JP | 02-105907 | A | 4/1990 |
| JP | 05-042488 | A | 2/1993 |
| JP | 09-232074 | A | 9/1997 |
| JP | 09-244590 | A | 9/1997 |
| JP | 11-045071 | A | 2/1999 |
| JP | 11-231834 | A | 8/1999 |
| JP | 11-311970 | A | 11/1999 |
| JP | 2000-066639 | A | 3/2000 |
| JP | 2000-200066 | A | 7/2000 |
| JP | 2001-109429 | A | 4/2001 |
| JP | 2001-109431 | A | 4/2001 |
| JP | 2001-296837 | A | 10/2001 |
| JP | 2002-152565 | A | 5/2002 |
| WO | WO 02/039420 | A1 | 5/2002 |
| WO | WO 02/091341 | A2 | 11/2002 |

* cited by examiner

DRIVING DEVICE, DISPLAY APPARATUS USING THE SAME, AND DRIVING METHOD THEREFOR

CROSS-REFERENCE TO RELATED APPLICATIONS

This is a Continuation Application of PCT Application No. PCT/JP03/08670, filed Jul. 8, 2003, which was published under PCT Article 21(2) in English.

This application is based upon and claims the benefit of priority from prior Japanese Patent Application No. 2002-199730, filed Jul. 9, 2002, the entire contents of which are incorporated herein by reference.

BACKGROUND OF THE INVENTION

1. Field of the Invention

The present invention relates to a driving device, a display apparatus using the driving device, and a driving method for the display apparatus and, more particularly, to a driving device for driving a current-driven optical element, a display apparatus for driving a simple matrix type display panel having display elements formed from a current-driven optical elements by using the driving device, and a driving method for the display apparatus.

2. Description of the Related Art

The recent years have seen a considerable proliferation of display apparatuses and devices, such as liquid crystal displays (LCDs), replacing cathode-ray tubes (CRTs), as the monitors and displays of personal computers and video equipment. Liquid crystal displays, in particular, have quickly come into widespread use because they can achieve decreases in thickness and weight, space saving, a reduction in power consumption, and the like as compared with conventional display apparatuses (CRTs). In addition, relatively small liquid crystal display apparatuses have been widely used as display devices for cell phones, digital cameras, personal digital assistants (PDAs), and the like which have recently become considerably popularized.

The following are expected as next-generation display devices (displays) and display elements following such liquid crystal displays: organic electroluminescence elements (to be abbreviated as "organic EL elements" hereinafter), inorganic electroluminescence elements (to be abbreviated as "inorganic EL elements" hereinafter), and display devices having spontaneous emission type optical elements such as light-emitting diodes (LEDs).

Among the above display devices having various kinds of spontaneous emission type display elements, display devices having display elements formed from organic EL elements made of organic compounds as light-emitting materials have recently undergone vigorous research and development toward practical application and commercialization because technical achievements superior to those obtained in other kinds of display elements have been obtained in terms of color display, low-voltage drive techniques, and the like.

FIGS. 13A, 13B, and 13C respectively show the schematic arrangement of an organic EL element, its voltage-current characteristic, and an equivalent circuit of the organic EL element. The structure, emission principle, and emission characteristics of the organic EL element will be briefly described below.

As shown in FIG. 13A, for example, an organic EL element OEL has an arrangement in which an anode electrode (positive electrode) 112 made of a transparent electrode material such as ITO (Indium Thin Oxide), an organic EL layer 113 made of a light-emitting material such as an organic compound, and a cathode electrode (negative electrode) 114 made of a metal material and having a reflection characteristic are sequentially stacked on one surface of a transparent insulating substrate 111 such as a glass substrate. The organic EL layer 113 is formed by, for example, stacking a hole transport layer 113*a* made of a polymer-based hole transport material and an electron transport light-emitting layer 113*b* made of a polymer-based electron transport light-emitting material.

In the organic EL element OEL, as shown FIG. 13A, when positive and negative voltages are applied from a DC voltage source $V_{DC}$ to the anode electrode 112 and cathode electrode 114, respectively, light hν is emitted on the basis of the energy produced when holes injected into the hole transport layer 113*a* recombine with electrons injected into the electron transport light-emitting layer 113*b* within the organic EL layer 113. For example, the light hν is transmitted through the anode electrode 112 and emerges from the other surface side (upper side in FIG. 13A) of the insulting substrate 111. In this case, the emission intensity (i.e., the emission luminance of the organic EL element) of the light hν is controlled in accordance with the amount of current flowing between the anode electrode 112 and the cathode electrode 114.

In this case, the voltage-current characteristic of an equivalent circuit of the organic EL element OEL exhibits a similar tendency to that of a diode, as shown in FIG. 13B, and the electrode layers (anode electrode 112 and cathode electrode 114) oppose each other through the relatively thin dielectric layer (organic EL layer 113). As shown in FIG. 13C, therefore, the optical element can be expressed as a parallel connection of a diode type light-emitting element Ep and a junction capacitance Cp. Note that the voltage-current characteristic of the organic EL element will be described in detail later in the embodiments of the present invention (to be described later).

As display driving methods for display apparatuses having display panels in which display elements (display pixels) having spontaneous emission type optical elements such as organic EL elements like those described above are arranged in the form of a matrix, the active matrix driving scheme and simple matrix (passive matrix) driving scheme are known. As is known, in the active matrix driving scheme, a selection switch and storage capacitance are provided for each display pixel to control the driven state (emission state) of each display element in accordance with the charge voltage of a corresponding one of the storage capacitances in the simple matrix driving scheme, the emission state of each display pixel is time-divisionally controlled by directly applying a predetermined pulse to the display element.

Although the active matrix driving scheme is superior to the passive one in terms of luminance and multi-gradation for image display, a pixel driving function such as a selection switch (thin-film transistor) must be provided for each display pixel. This complicates the apparatus arrangement and demands a more advanced micropatterning technique, resulting in an increase in product cost. In contrast to this, in the simple matrix driving scheme, there is no need to prepare a pixel driving function such as a selection switch for each display pixel, and hence the apparatus arrangement can be simplified. This makes it possible to improve the manufacturing yield and reduce the product cost.

The schematic arrangement of a display apparatus based on the simple matrix driving scheme will be described below.

FIG. 14 shows an example of the display apparatus based on the simple matrix driving scheme.

As shown in FIG. 14, the display apparatus based on the simple matrix driving scheme is roughly comprised of a display panel 110P having a plurality of scanning lines SL extended in a row direction, a plurality of signal lines DL extended in a column direction to intersect the scanning lines SL at right angles, and display elements (organic EL elements) OEL each formed near the intersection of the scanning line SL and the signal line DL. The apparatus further includes a scanning driver 120P which applies a scanning signal to each scanning line SL at a predetermined timing to sequentially scan the organic EL elements OEL on each row in the selected state, a data driver 130P which generates a driving current corresponding to display data and supplies the current to each organic EL element OEL through a corresponding one of the signal lines DL in synchronism with scanning by the scanning driver 120P, and a controller 140P which generates a scanning control signal, data control signal, and display data which are used to display desired image information on the display panel 110P, and supplies them to the scanning driver 120P and data driver 130P.

As driving methods for the display apparatus having the above arrangement, the following two methods are known. One method is a current designation type driving method in which the scanning driver 120P sequentially applies a scanning signal for selecting one of the scanning lines SL to the scanning line SL of each row on the basis of a scanning control signal supplied from the controller 140P in each predetermined scanning period, and the data driver 130P generates a driving current having a predetermined current value corresponding to display data in the scanning period on the basis of a data control signal and display data supplied from the controller 140P in synchronism with this scanning signal, and simultaneously supplies driving currents through the respective signal lines DL. Thus the respective organic EL elements OEL on a selected row emit light with a predetermined luminance level. The other method is a pulse width modulation type driving method in which the data driver 130P generates a driving current formed from a constant current value and having a signal time width (pulse signal width) corresponding to display data, and supplies the current to each signal line DL. Thus the respective organic EL elements OEL on a selected row emit light with a predetermined luminance level. This operation is sequentially repeated for each row corresponding to one frame on the display panel to display desired image information on the display panel 110P.

In the simple matrix driving scheme, a voltage driving scheme of driving each display element by applying a predetermined voltage from the data driver to the display element is known in addition to the above current driving scheme. Assume that the organic EL element is used as a display element. In this case, since each element has an arrangement in which the diode type light-emitting element Ep and junction capacitance Cp are connected in parallel as shown in FIG. 14, and each organic EL element OEL is connected in parallel with the signal line DL, the total sum of junction capacitances becomes large, and the interconnection capacitance of each signal line is added. As a consequence, in the voltage driving scheme, a delay occurs in the driven state of each display element or a voltage drop occurs in accordance with the distance from the data driver, resulting in, for example, variations in emission state (luminance) in the upper and lower areas of the display panel. This leads to a deterioration in display image quality. In a display apparatus using organic EL elements as display elements, therefore, the current driving scheme is regarded superior to the voltage driving scheme.

The display apparatus based on the above simple matrix driving scheme, however, has the following problems.

In the current driving scheme, operating a display element with a predetermined luminance level by supplying a predetermined driving current to it is equivalent to charging the junction capacitance or the like of a given display element with a driving current and also charging the junction capacitance of the remaining unselected display elements on a signal line to which the given display element is connected. In this case, as compared with the voltage driving scheme, a deterioration in response characteristic or the occurrence of variations in emission luminance can be suppressed by supplying a driving current having a large current value. Assume, however, that the driving current supplied from the data driver is set to a relatively small current value for the sake of the specifications of a power supply or power saving, or the total sum of the junction capacitances of display elements increases as the number of scanning lines increases and the number of display pixels increases along with increases in the size and resolution of a display panel. In this case, when the driving current is supplied to the display element at a driving timing, the response characteristics with respect to current and voltage values deteriorate, and the time required for a voltage applied to the display element to reach a predetermined value is prolonged, resulting in a noticeable lack of emission luminance and occurrence of variations.

FIG. 15A shows a change in supply current over time when a driving current is supplied to a display element. FIG. 15B shows a change in voltage applied to a display element over time. Referring to FIG. 15A, the abscissa represents the time; and, the ordinate, the supply current to the display element. Reference symbol Tspy denotes a supply period of a driving current; and Tdly, a delay time from the start of supply of the driving current to the start of operation of the display element. Referring to FIG. 15B, the abscissa represents the time; and the ordinate, the voltage applied to a display pixel in the forward direction. Reference symbol Vth denotes a threshold voltage for operation in the display element. As shown in FIGS. 15A and 15B, the rise characteristics of a current value and voltage value supplied to the display element deteriorate owing to the junction capacitance of the display element and the interconnection capacitance of a signal line. In addition, owing to variations in junction capacitance among the respective display elements, differences in interconnection capacitance among signal lines, and the like, the degree of deterioration varies. As a consequence, the amount of electric charges supplied to the display element in a driving current supply period decreases below the amount required for display with a desired luminance level, resulting in a lack of emission luminance or variations in emission luminance among the display elements. This leads to a deterioration in display state.

BRIEF SUMMARY OF THE INVENTION

According to the present invention, in a driving device which drives a plurality of current-driven optical elements, the response speed of each optical element can be increased, and hence each optical element can be properly driven even if a driving current to be supplied to each optical element is set to a relatively small current value.

In addition, in a display apparatus to which the driving device is applied and which drives a display panel having a plurality of current-driven display elements, the response speed of each display element in the entire area of the display panel is increased to obtain good display image quality in accordance with a display gray level, and the power consumption associated with supply of a driving current to each display element can be reduced.

In order to obtain the above effects, according to the present invention, there is provided a driving device which supplies a current to a plurality of current-driven optical elements to drive the optical elements, comprising at least a driving current supply circuit which supplies a driving current to each optical element for a predetermined period, and a control voltage applying circuit which applies at least a charge voltage having a voltage value corresponding to a voltage to be applied to each optical element using the driving current, before the driving current is supplied.

The driving current supplied to each optical element has the same current value with respect to each optical element.

The driving current supply circuit comprises a single constant current generating circuit which outputs a constant current having the same current value as that of the driving current, and a plurality of current storage circuits which sequentially receive and hold the constant current and output the driving current on the basis of the constant current. Alternatively, the driving current supply circuit further comprises a single input current storage circuit which is provided between the constant current generating circuit and the plurality of current storage circuits, receives the constant current output from the constant current generating circuit, holds a voltage component corresponding to a current value of the constant current, and supplies a current based on the voltage component to the plurality of current storage circuits.

The input current storage circuit and each of the current storage circuits include a capacitance element which receives the constant current output from the constant current generating circuit and in which electric charge corresponding to a current value of the constant current is written as a voltage component.

The control voltage applying circuit further comprises means for applying a discharge voltage having a voltage value for causing each optical element to perform discharging operation, after the driving current is supplied to each optical element.

The driving device also comprises a pulse width control circuit which controls a pulse width of the driving current applied to each optical element in accordance with a luminance level component of a display signal.

In order to obtain the above effects, according to the present invention, there is provided a display apparatus which displays image information by supplying a driving current corresponding to a display signal to each of a plurality of current-driven display elements of a display panel, comprising a display panel including a plurality of signal lines and a plurality of scanning lines intersecting at right angles, and the plurality of display elements arranged near intersections of the signal lines and the scanning lines, a scanning control circuit which sequentially scans the scanning lines to sequentially set the display elements connected to the scanning lines in a selected state, and a signal control circuit including at least a driving current supply circuit which supplies a driving current to each signal line for a predetermined period, and a control voltage applying circuit which applies, to each signal line, a charge voltage having a voltage value based on a voltage applied to each display element upon application of the driving current, before supply of the driving current. The display element comprises an optical element, which is, for example, an organic electroluminescence element, the organic electroluminescence element having an anode electrode connected to the signal line, and a cathode electrode connected to the scanning line.

The charge voltage has at least a voltage value which is higher than a threshold voltage for each display element of the display panel and smaller than a maximum value of a voltage value applied to each display element when the driving current is supplied to each display element through each signal line. Alternatively, the charge voltage has a voltage value equal to an average value of voltage values applied to the respective display elements when the driving current is supplied to the respective display elements through the respective signal lines.

The driving current supplied to each signal line of the display panel has the same current value for each signal line.

The signal control circuit comprises at least a control section which performs supply of the driving current by the driving current supply circuit and application of the charge voltage by the control voltage applying circuit in accordance with a timing at which the scanning control circuit sets the display element in a selected state.

The driving current supply circuit in the signal control circuit comprises a single constant current generating circuit which outputs a constant current having a predetermined current value, and a plurality of current storage circuits which are provided in correspondence with the plurality of signal lines, sequentially receive and hold the constant current, and simultaneously output the driving currents to the plurality of signal lines on the basis of the constant current. Alternatively, the driving current supply circuit further comprises a single input current storage circuit which is provided between the constant current generating circuit and the plurality of current storage circuits, receives the constant current output from the constant current generating circuit, holds a voltage component corresponding to a current value of the constant current, and supplies a current based on the voltage component to the plurality of current storage circuits.

The current storage circuit and input current storage circuit each include a capacitance element which receives the constant current output from the constant current generating circuit and in which electric charge corresponding to the constant current is written as the voltage component.

The control voltage applying circuit in the signal control circuit further comprises means for applying, to each signal line, a discharge voltage which causes each display element to perform discharging operation and does not exceed a threshold voltage of the display element, after the driving current is supplied to each signal line.

The signal control circuit comprises a pulse width control circuit which controls a pulse width of the driving current to each signal line in accordance with a luminance level component of a display signal.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of a driving device, a display apparatus using the driving device, and a driving method for the display apparatus according to the present invention will be described in detail below.

<Arrangement of Display Apparatus>

The schematic arrangement of a driving device according to the present invention and a display apparatus to which the driving device can be applied will be described first with reference to the several views of the accompanying drawing.

Figure 1:
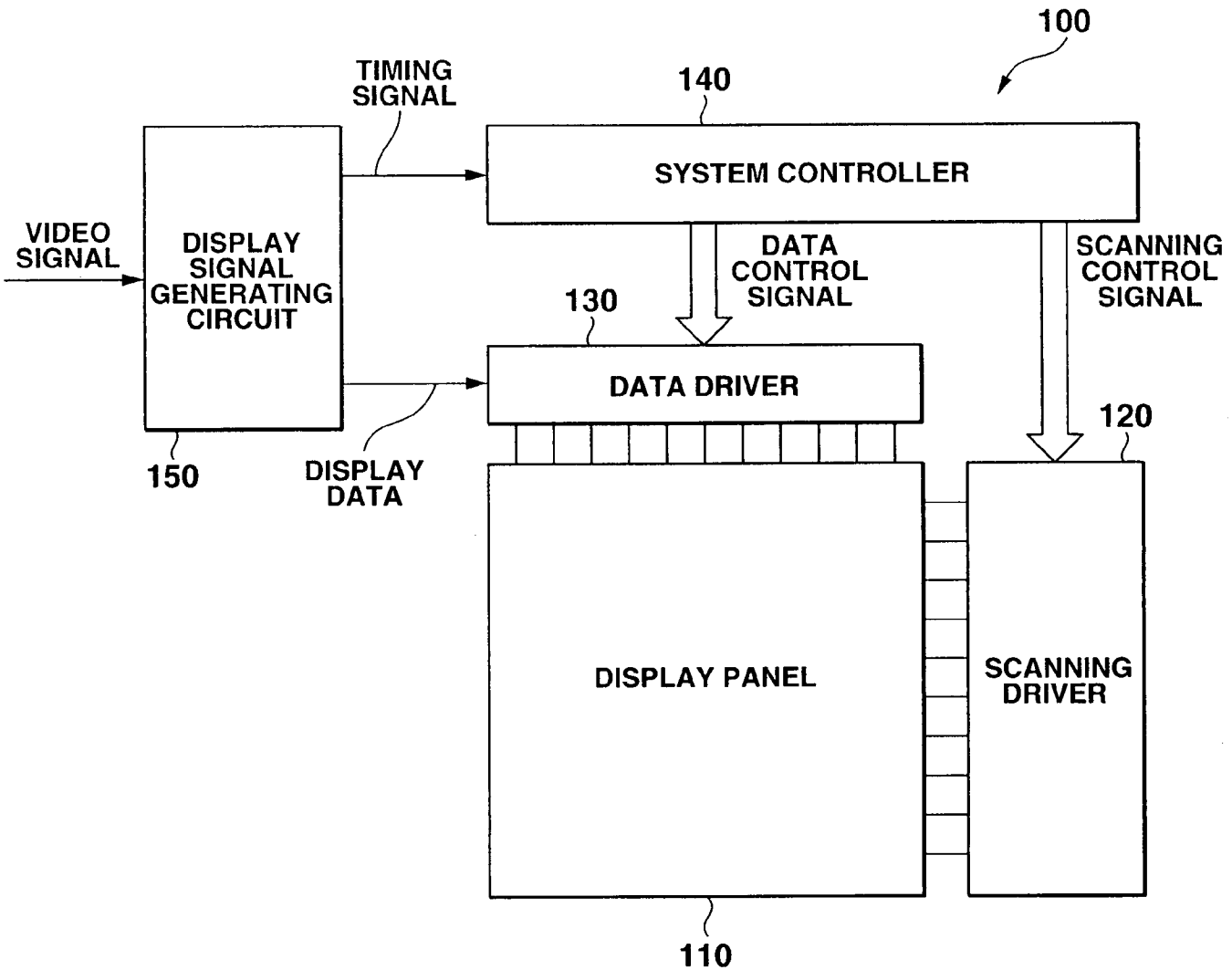
FIG. 1 is a block diagram showing an example of the overall arrangement of a driving device and a display apparatus using the driving device.
Figure 2:
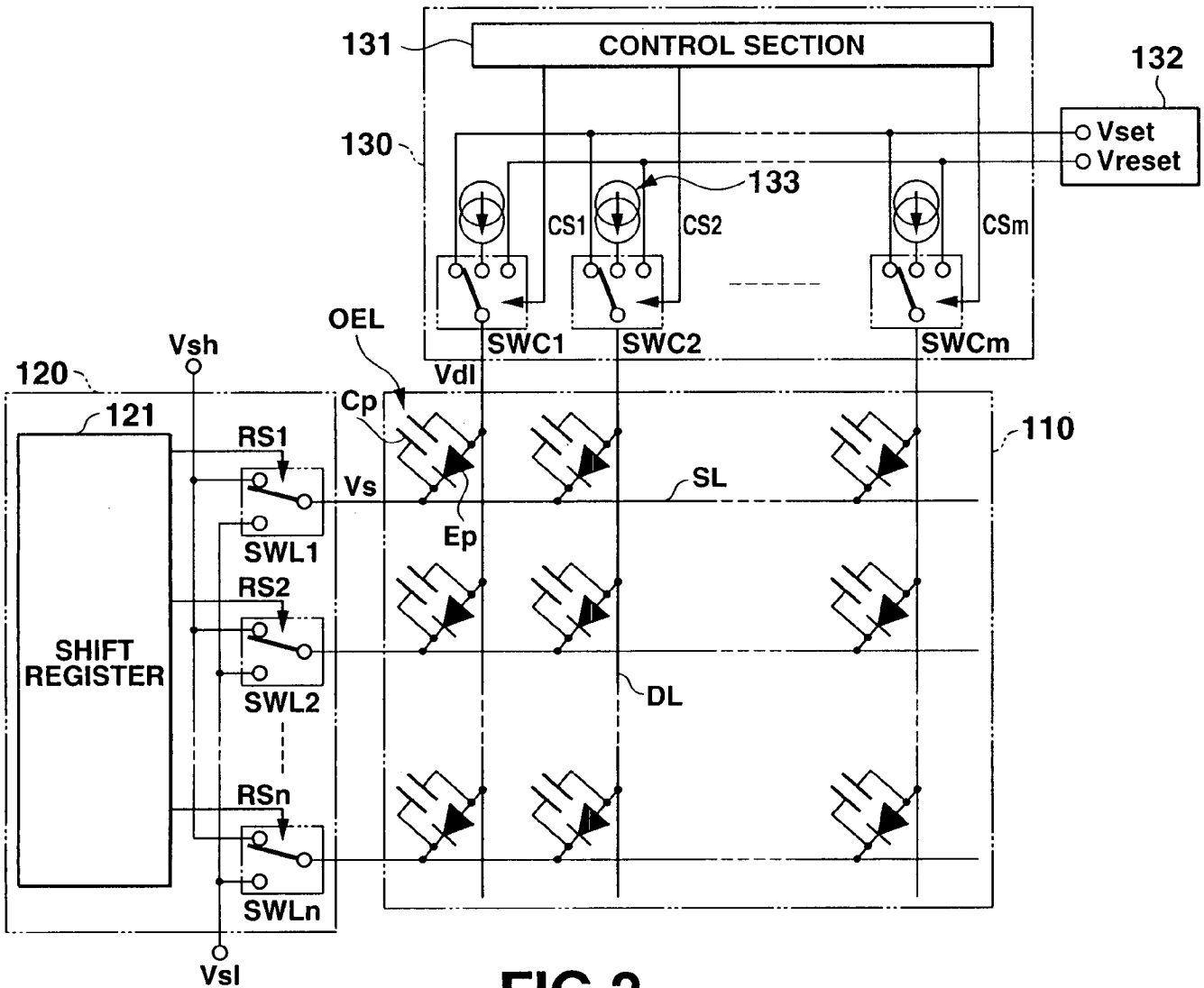
FIG. 2 is a schematic circuit diagram showing the arrangement of a part of the display apparatus to which the present invention can be applied.

FIG. 1 is a block diagram showing an example of the overall arrangement of the driving device according to the present invention and the display apparatus to which the driving device can be applied. FIG. 2 is a schematic circuit diagram showing the arrangement of the main part of the display apparatus to which the present invention can be applied.

In the following description, organic EL elements OEL are used as display elements for a display panel. However, the display apparatus according to the present invention is not limited to this. The present invention can also be suitably applied to a case wherein optical elements such as light-emitting diodes (LEDs) are used as display elements instead of organic EL elements.

As shown in FIGS. 1 and 2, a display apparatus 100 to which the present invention can be applied is comprised of a display panel (pixel array) 110, scanning driver (scanning control circuit) 120, data driver (signal control circuit) 130, system controller 140, and display signal generating circuit 150. In the display panel 110, display elements including, for example, organic EL elements OEL are formed near the intersections of a plurality of scanning lines SL and a plurality of signal lines DL which are arranged in orthogonal directions. The scanning driver 120 is connected to the scanning lines SL of the display panel 110 and controls the display elements on each row in the selected state by sequentially applying a scanning signal Vs to each scanning line SL at a predetermined timing. The data driver 130 is connected to the signal lines DL of the display panel 110, supplies a constant current (driving current) Ic having a signal time width (pulse width) corresponding to display data in synchronism with the application timing of the scanning signal Vs, and applies a set voltage Vset (charge voltage) or reset voltage Vreset (discharge voltage) at a predetermined timing. The system controller 140 generates and outputs at least a scanning control signal and data control signal for controlling the operation states of the scanning driver 120 and data driver 130, on the basis of a timing signal supplied from the display signal generating circuit 150. The display signal generating circuit 150 supplies the above display data to the data driver 130 on the basis of a video signal supplied from the outside of the display apparatus 100, generates a timing signal (system clock or the like) for operating each organic EL element in a predetermined driven state on the basis of the display data, and supplies the timing signal to the system controller 140.

The arrangement of each of the above components will be described below.

(Display Panel)

Figure 13A:
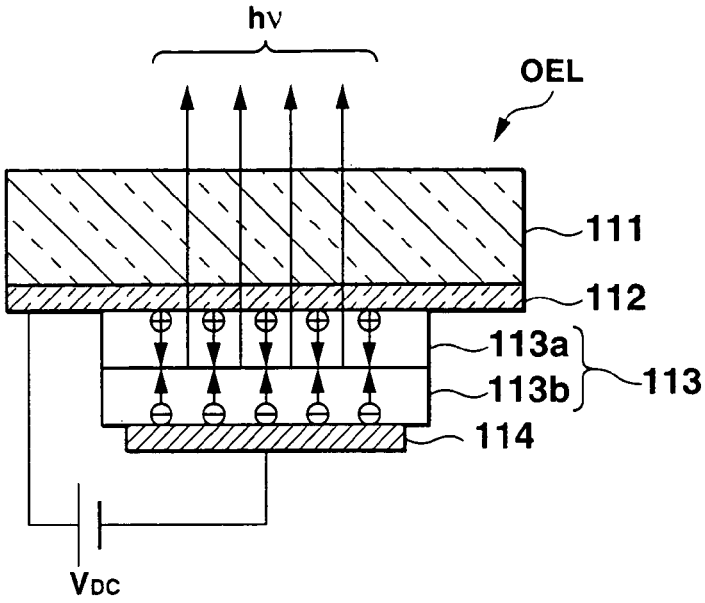
FIG.13A PRIOR ART
FIG. 13A is a sectional view showing the schematic arrangement of an organic EL element.
Figure 13B:
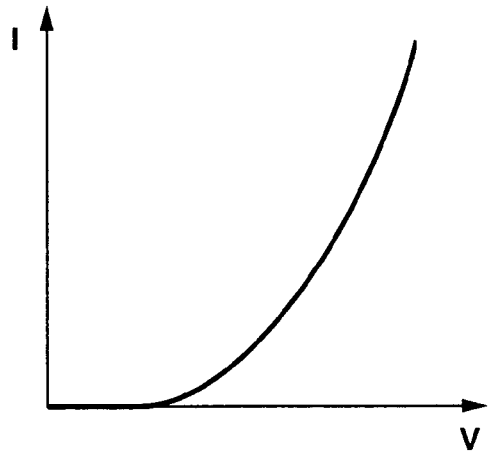
FIG.13B PRIOR ART
FIG. 13B is a graph showing the approximate voltage-current characteristic of the organic EL element.
Figure 13C:
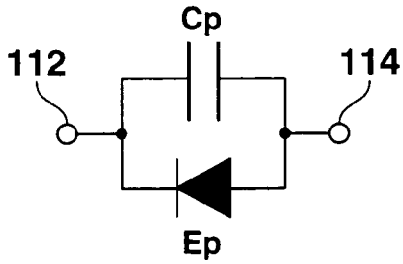
FIG.13C PRIOR ART
FIG. 13C is an equivalent circuit diagram of the organic EL element.
Figure 14:
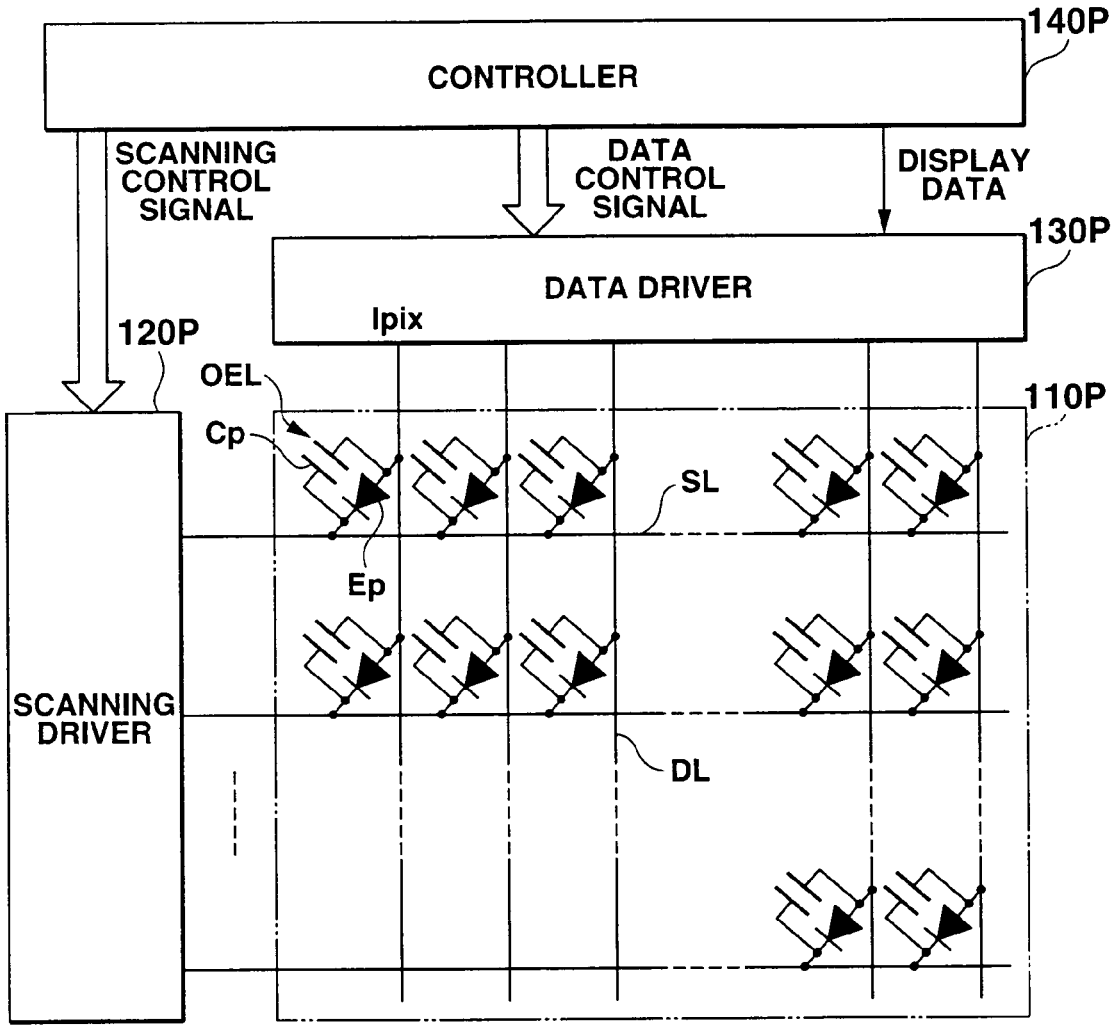
FIG.14 PRIOR ART
FIG. 14 is a view showing an example of a display apparatus based on the simple matrix driving scheme.
Figure 15A:
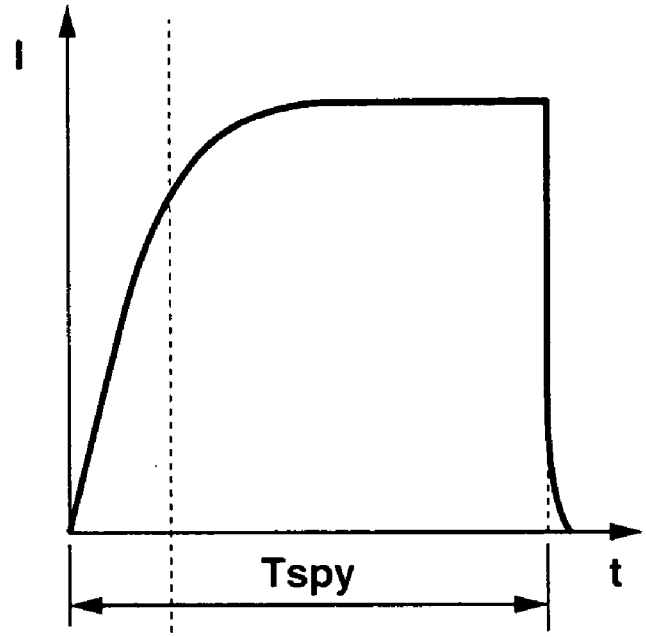
FIG.15A PRIOR ART
FIG. 15A is a graph showing a change in supply current over time when a driving current is supplied to an organic EL element.
Figure 15B:
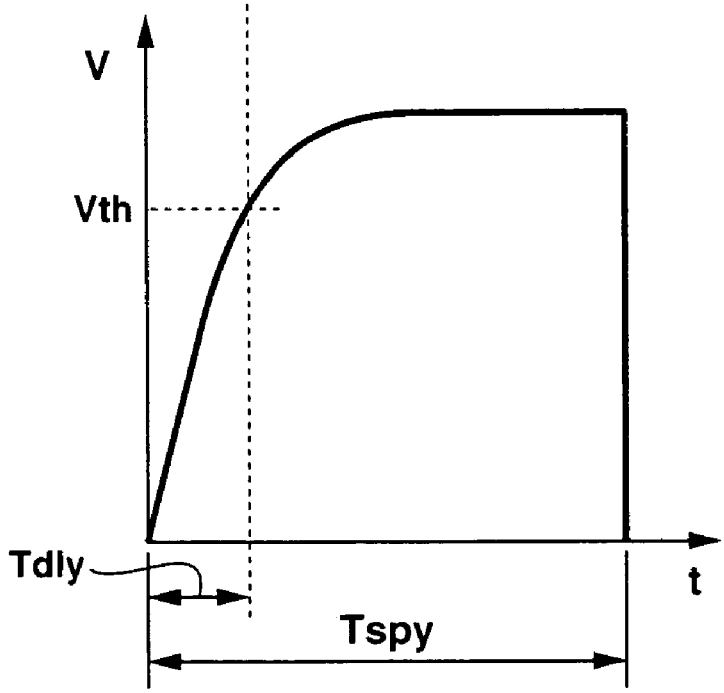
FIG.15B PRIOR ART
FIG. 15B is a graph showing a change in voltage applied to a display element over time when a driving current is supplied to an organic EL element.

As shown in FIG. 2, the display panel 110 which can be applied to the present invention has n scanning line SL and m signal lines DL which are intersecting each other at right angles. The display panel 110 has a simple matrix arrangement in which the organic EL elements OEL each having the cross-sectional structure shown in FIG. 13A are formed at the intersections of the respective signal lines DL and the respective scanning lines SL with the anode electrodes (positive electrodes) and cathode electrodes (negative electrodes) of the elements being connected to the signal lines DL and the scanning lines SL, respectively. In this case, each organic EL element OEL has an arrangement in which a diode type display element Ep and a junction capacitance Ca are connected in parallel as in FIG. 14.

(Scanning Driver)

The scanning driver 120 sets display elements on each row in the selected state by sequentially applying the scanning signal Vs (=Vs1) to each scanning line SL on the basis of a scanning control signal supplied from the system controller 140, thereby performing control to write the constant driving current Ic supplied from the data driver 130 through the signal line DL and apply the predetermined reset voltage Vreset.

As shown in FIG. 2, the scanning driver 120 is comprised of a shift register 121, switches SWL1, SWL2, . . . , SWLn (to be also referred to as "switches SWL" herein after for the sake of convenience), high-voltage power supply, and low-voltage power supply. The shift register 121 sequentially outputs shift output signals RS1, RS2, . . . , RSn (to be also referred to as "shift output signals RS" hereinafter for the sake of convenience) on the basis of scanning control signals (a shift start signal, shift clock, and the like) supplied from the system controller 140. The switches SWL1, SWL2, . . . , SWLn are provided for the respective scanning lines SL, and the contacts of the switches are switched on the basis of the shift output signals RS1, RS2, . . . , RSn. The high-voltage power supply commonly applies a signal voltage Vsh (charge control voltage) of a predetermined high voltage (high level) to one of the switching contacts of each of the switches SWL1, SWL2, . . . , SWLn. The low-voltage power supply commonly applies a signal voltage Vs1 (driving control voltage) of a predetermined low voltage (low level) to the other of the switching contacts of each of the switches SWL1, SWL2, . . . , SWLn. When the shift output signals RS1, RS2, . . . , RSn which are generated by the shift register 121 while it sequentially shifts from the upper side of the display panel 110 to the lower side are input to the switches SWL1, SWL2, . . . , SWLn, the switching contacts are sequentially switched to the low-voltage power supply side. As a consequence, the scanning signal Vs having the low-level signal voltage Vs1 is applied to the anode electrodes of the organic EL elements OEL on the selected row (scanning line) for only a predetermined period (the supply period of the driving current Ic and the application period of the reset voltage Vreset in one scanning period). Note that in a state wherein the shift output signals RS1, RS2, . . . are not input from the shift register 121 to the switches SWL1, SWL2, . . . , SWLn (no row is selected), the switching contacts of the switches SWL1, SWL2, . . . , SWLn are switched to the power supply side, and the scanning signal Vs having the high-level signal voltage Vsh is applied. Each switch SWL is formed from a switch element such as a field-effect transistor.

(Data Driver)

Figure 3:
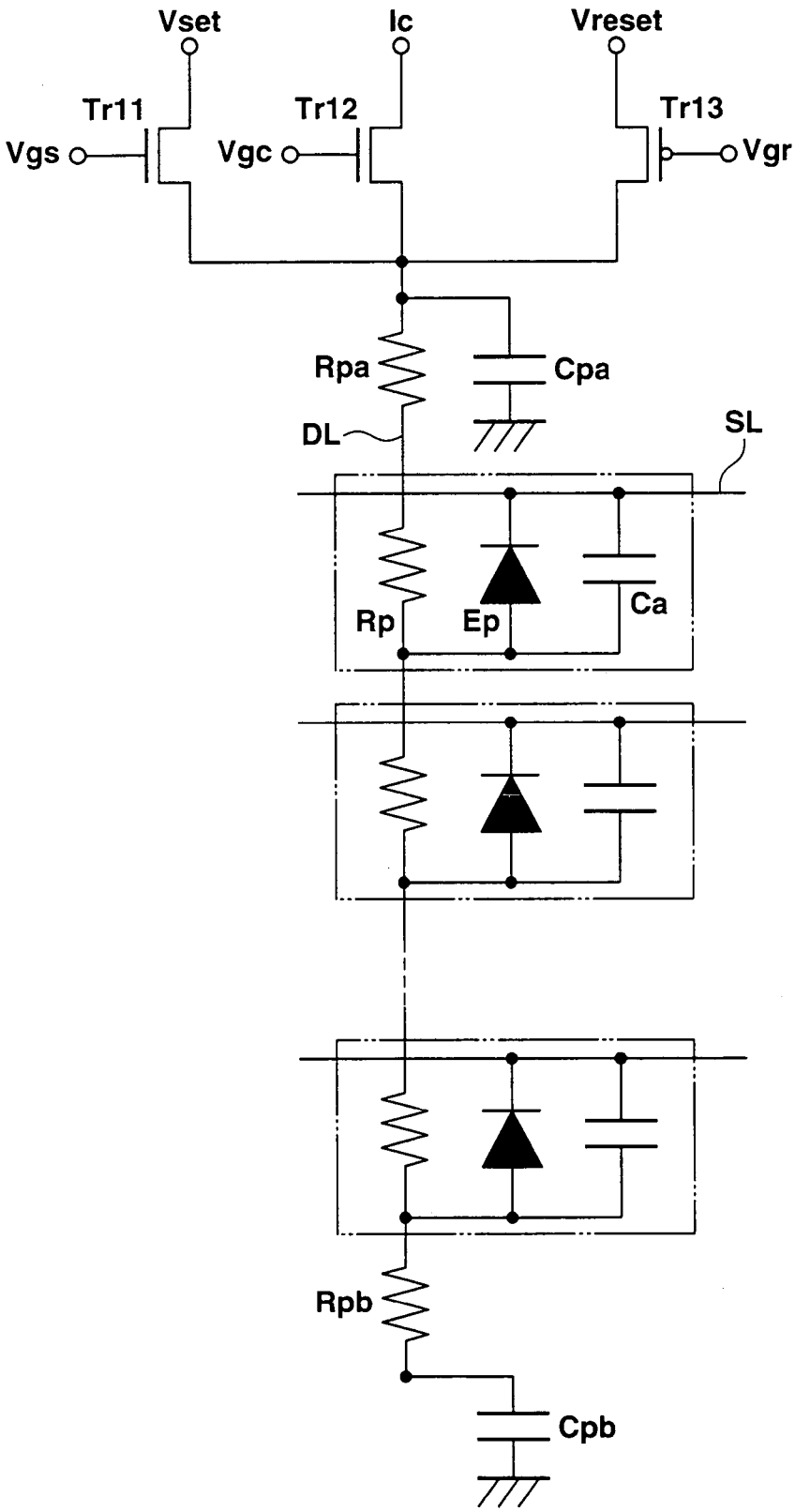
FIG. 3 is a circuit diagram showing the arrangement of a part of a data driver which can be applied to the driving device according to the present invention.

FIG. 3 is a circuit diagram showing the arrangement of the main part of the data driver which can be applied to the driving device according to the present invention.

The data driver 130 sequentially receives and holds display data line by line supplied from the display signal generating circuit 150 at a predetermined timing on the basis of various data control signals (an output enable signal, output control signal, shift start signal, shift clock, and the like) supplied from the system controller 140. The data driver 130 converts each display data into a current component of a constant value with a signal time width (pulse width) corresponding to the luminance level of the display data, and supplies the data to each signal line DL at a predetermined timing within a scanning period set for each of the above scanning lines.

As shown in FIG. 2, the data driver 130 is comprised of a control section 131, switches SWC1, SWC2, . . . , SWCm (to be also referred to as "switches SWC" hereinafter for the sake of convenience), a control voltage applying circuit 132, and constant current supply circuits 133 (driving current supply circuits). The control section 131 outputs control signal CS1, CS2, . . . , CSm in accordance with a timing at which the scanning driver 120 sets display elements on each row in the selected state by applying the scanning signal Vs to each scanning line SL on the basis of data control signals (output control signals and the like) supplied from the system controller 140. The switches SWC1, SWC2, . . . , SWCm are provided for the respective signal lines DL, and the contacts of the switches are switched on the basis of control signal CS1, CS2, . . . , CSm supplied from the control section 131. The control voltage applying circuit 132 commonly applies the set voltage Vset (charge voltage) of a predetermined high voltage (high level) to the first switching contacts of the switches SWC1, SWC2, . . . , SWCm, and commonly applies the reset voltage Vreset (discharge voltage) of a predetermined low voltage (low level) to the third switching contacts of the switches SWC1, SWC2, . . . , SWCm. The set voltage Vset is set to a value corresponding to a potential to be applied to the display element by supplying the constant driving current Ic and that is equal to or more than at least the threshold voltage of the display element and does not exceed the maximum voltage applied to each display element when the driving current Ic is supplied. More preferably, the set voltage Vset is set to the average voltage of the maximum voltage and minimum voltage at the signal line DL when the driving current Ic is supplied. The reset voltage Vreset is set to a value that can temporarily release and reset the charge of the signal line DL and, for example, set to ground potential (0 V). More preferably the reset voltage Vreset is set to be slightly lower than the threshold voltage of the display element. Each of the constant current supply circuits 133 supplies the driving current Ic having a constant current value and a signal time width (pulse width) based on the luminance graduation component of display data to the second switching contact of a corresponding one of the switches SWC1, SWC2, . . . , SWCm. A constant current supply circuit which can be applied to the data driver according to the present invention will be described in detailed later.

FIG. 3 is a circuit diagram showing an example of an arrangement of the switches SWC which can be applied to the data driver 130. For example, as shown in FIG. 3, each of the switches SWC1, SWC2, . . . , SWCm provided for the respective signal lines DL of the data driver 130 can have an arrangement including a switch element (to be referred to as an "NMOS transistor" hereinafter) Tr11, NMOS transistor Tr12, and switch element (to be referred to as a "PMOS transistor" hereinafter) Tr13. The NMOS transistor Tr11 is formed from an n-channel field-effect transistor and has a source terminal connected to the high-voltage power applying circuit 132 for applying the constant set voltage Vset, a drain terminal connected to the signal line DL, and a gate terminal to which a control signal Vgs is applied at the first timing. The NMOS transistor Tr12 has a source terminal connected to the constant current supply circuit 133 for supplying the constant driving current Ic, a drain terminal connected to the signal line DL, and a gate terminal to which a control signal Vgc is applied at the second timing. The PMOS transistor Tr13 is formed from a p-channel field-effect transistor and has a source terminal connected to the low-voltage power applying circuit 134 for applying the constant reset voltage Vreset, a drain terminal connected to the signal line DL, and a gate terminal to which a control signal Vgr is applied at the third timing.

That is, the switches SWC1, SWC2, . . . , SWCm each have an arrangement in which the NMOS transistors Tr11 and Tr12 and PMOS transistor Tr13 are connected in parallel with the single signal line DL. The switches SWC1, SWC2, . . . , SWCm are selectively turned on at different timings to supply predetermined voltages or currents to the signal lines DL.

The control signals Vgs, Vgc, and Vgr applied to the gate terminals of the NMOS transistors Tr11 and Tr12 and the PMOS transistor Tr13 are generated on the basis of data control signals supplied from the system controller 140 and display data supplied from the display signal generating circuit 150, and are selectively applied to the respective transistors at predetermined timings within a scanning period set for each row (scanning line). The operations of these switches SWC1, SWC2, . . . , SWCm and voltage and current components supplied to the signal lines DL will be described in detail later.

Referring to FIG. 3, resistance components Rpa, Rp, and Rpb formed in series with the signal line DL are equivalent representations of the interconnection resistances of the signal line DL, and capacitance components Cpa and Cpb formed on the two ends of the signal line DL are interconnection capacitances (parasitic capacitances) which are parasitic on the signal line DL.

(System Controller)

The system controller 140 generates and outputs, to the scanning driver 120 and data driver 130, a scanning control signal and data control signal for controlling their operation states to make the respective drivers operate at predetermined timings so as to generate and output the scanning signal Vs, driving current Ic, set voltage Vset, and reset voltage Vreset. The system controller 140 then supplies the scanning signal Vs to the cathode electrode of each organic EL element, and the driving current Ic, set voltage Vset, and reset voltage Vreset to the anode electrode of each organic EL element to make each organic EL element operate with a predetermined luminance level so as to display image information based on a predetermined video signal on the display panel 110.

(Display Signal Generating Circuit)

The display signal generating circuit 150 extracts luminance level signal components from a video signal supplied from, for example, the outside of the display apparatus, and supplies the signal components as display data to the data driver 130 for each line of the display panel 110. If the above video signal contains a timing signal component for defining the display timing of image information like a TV broadcast signal (composite video signal), the display signal generating circuit 150 (FIG. 1) may have the function of extracting a timing signal component and supplying it to the system controller 140 as well as the function of extracting the above luminance level signal component. In this case, the system controller 140 described above generates a scanning control signal and data control signal to be respectively supplied to the scanning driver 120 and data driver 130, on the basis of timing signals supplied from the display signal generating circuit 150.

<Driving Method for Driving Device>

The operations of the above scanning driver and data driver and voltage and current components supplied to the scanning lines and signal lines will be described in detail next with reference to the several views of the accompanying drawing.

Figure 4:
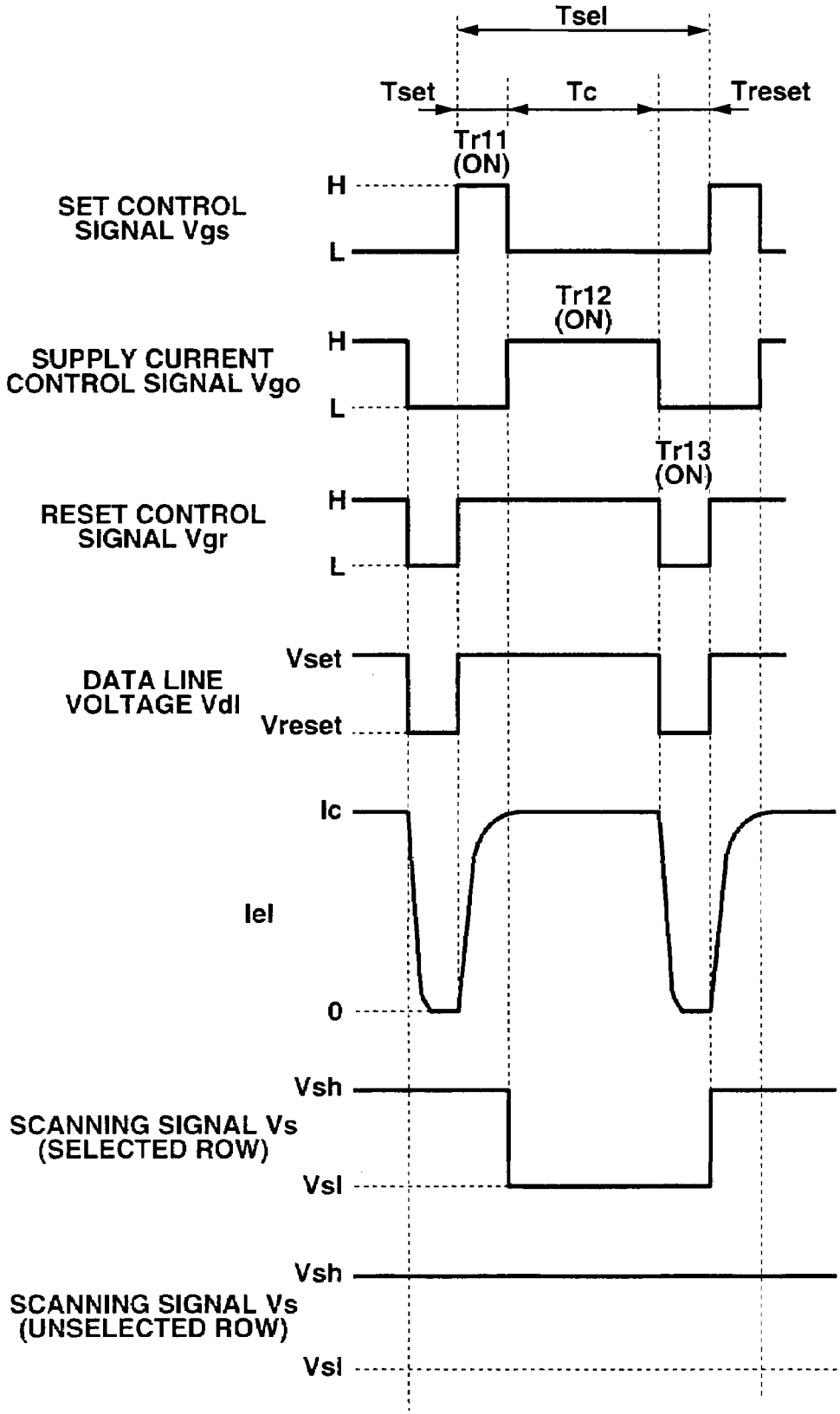
FIG. 4 is a timing chart showing control operation in a scanning driver and the data driver which can be applied to the present invention.
Figure 5:
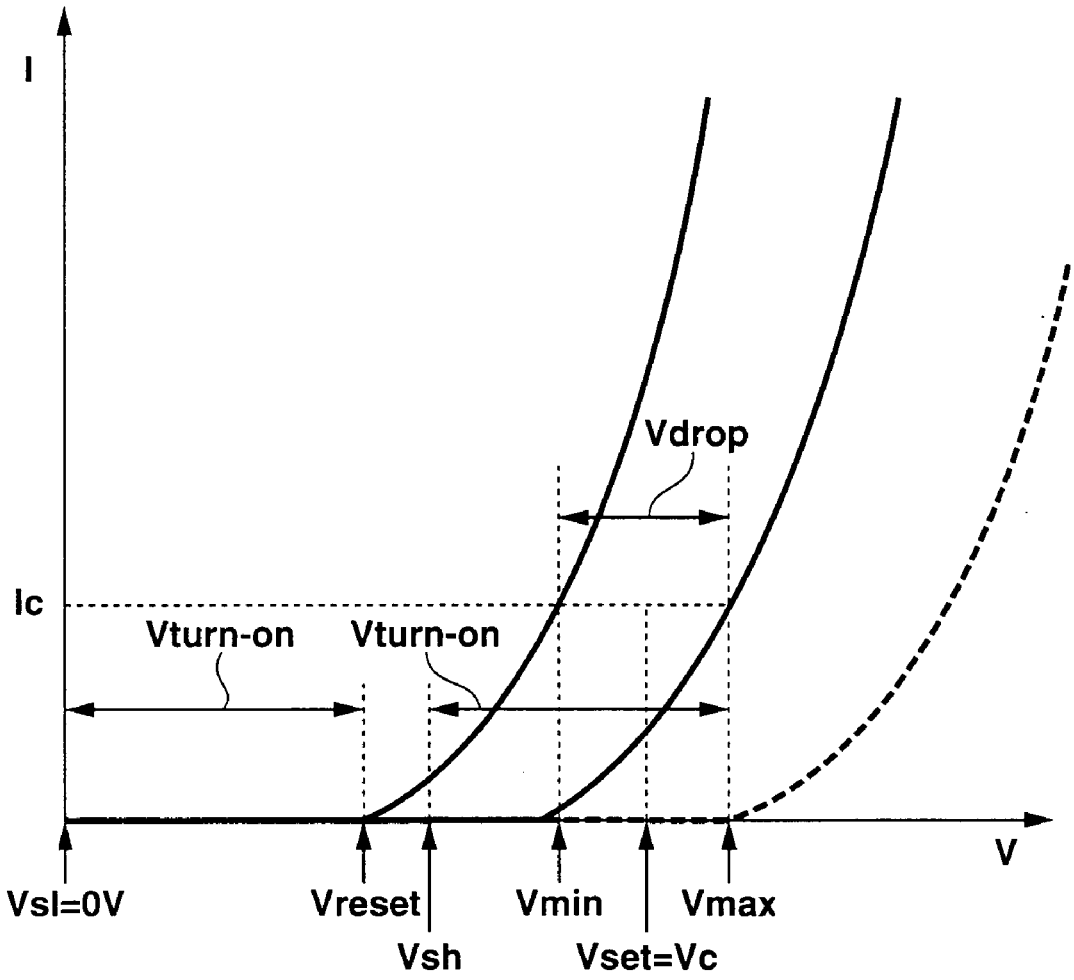
FIG. 5 is a graph showing voltage-current characteristics representing the relationship between voltages applied by the scanning driver and data driver which can be applied to the present invention.
Figure 6:
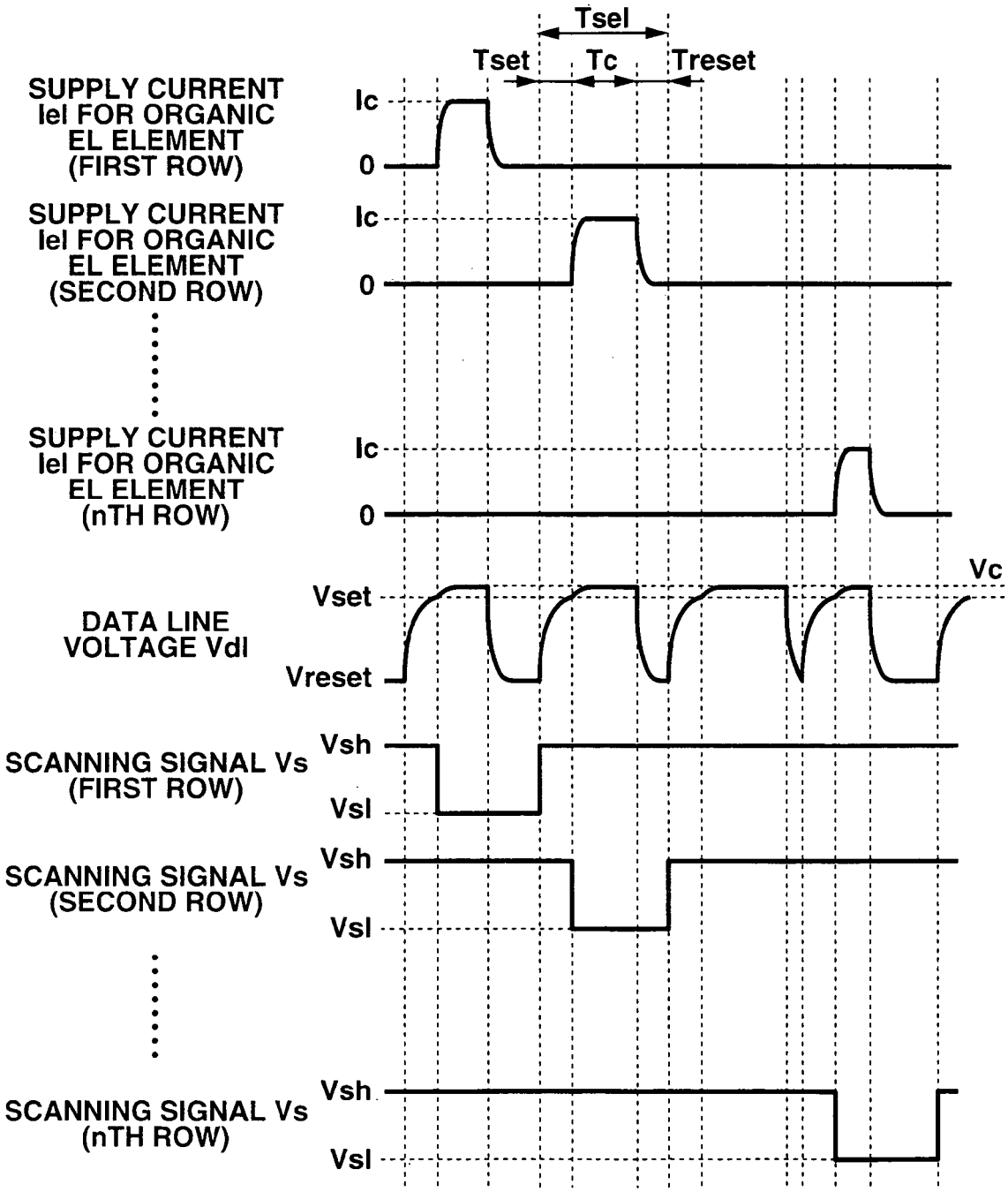
FIG. 6 is a timing chart showing display driving operation in the display apparatus to which the present invention can be applied.

FIG. 4 is a timing chart showing the control operations (driving method) of the scanning driver and data driver which can be applied to the present invention. FIG. 5 is a graph showing voltage-current characteristics representing the relationship between the voltages applied from the scanning driver and data driver which can be applied to the present invention. FIG. 6 is a timing chart showing the display driving operation of the display apparatus to which the present invention can be applied.

In the control operations of the scanning driver and data driver according to the present invention, as shown in FIG. 4, a set period Tset during which the above set voltage Vset (charge voltage) is applied to each signal line DL, a constant current supply period Tc during which the driving current Ic is supplied to each signal line DL, and a reset period Treset during which the reset voltage Vreset (discharge voltage) is applied to each signal line DL are sequentially set within a scanning period Tsel (selection period) which is set for each scanning line at different timings. Note that FIG. 4 shows a case wherein the display elements on a specific row (scanning line) are driven.

(Set Period)

In the set period Tset, as shown in FIG. 4, at the start timing of a scanning period set for a specific row, the high-level set control signal Vgs is applied to the gate terminal of the NMOS transistor Tr11 provided in the data driver 130 to turn on the transistor, and the reset high-level control signal Vgr is applied to the gate terminal of the PMOS transistor Tr13 to turn off the transistor. At this time, the low-level current supply control signal Vgc is applied to the gate terminal of the NMOS transistor Tr12 to keep it off. As a consequence, the set voltage Vset having a predetermined high voltage (e.g., 12 V) is applied to the signal line DL through the NMOS transistor Tr11, and applied to the anode electrode of the organic EL element through the signal line DL (signal line voltage Vdl=Vset).

The set voltage Vset is set to a value corresponding to a potential (Vc) to be applied to the display element by supplying the constant driving current Ic to the signal line DL during the constant current supply period Tc (to be described later). That is, as shown in FIG. 5, when the driving current Ic is applied to the signal line DL, a voltage drop Vdrop occurs in accordance with the interconnection length from the data driver 130 serving as a power supply to the organic EL element OEL. As a consequence, a maximum voltage Vmax is applied to the side nearest to the data driver 130 and a minimum voltage Vmin is applied to the side farthest from the data driver 130. As will be described later, in order to set the organic EL elements OEL connected to all the scanning lines SL in the non-emission state, it suffices if the set voltage Vset is set to a value that is equal to or more than at least the threshold voltage (turn-on voltage) of the organic EL element OEL and does not exceed the maximum voltage Vmax applied to each display element when the driving current Ic is supplied. More preferably, in order to improve the uniformity of the effect obtained in the overall display panel by applying the set voltage Vset, the set voltage Vset is set to a voltage that can supply the driving current Ic having a constant current value to the organic EL element OEL in the central area of the display panel 110, i.e., the average voltage of the maximum voltage Vmax and minimum voltage Vmin at the signal line DL.

In addition, in the set period Tset, the switch SWL provided in the scanning driver 120 is connected to the switching contact on the high-voltage power supply side to apply the high-level scanning signal Vs (=Vsh) to the scanning line SL (the cathode electrode of the organic EL element). In this case, the high-level scanning line Vs (=Vsh) is applied from the scanning driver 120 to the scanning lines SL of the remaining rows in the unselected state as well as the above specific row.

In the set period Tset, the high-level scanning signal Vs (=Vsh) applied to the scanning lines SL of all the rows is set to a voltage (e.g., 9 V) at which the organic EL elements OEL connected to all the scanning lines SL emit no light even if the above maximum voltage (Vmax) is applied as the set voltage Vset to the signal line DL. More specifically, as shown in FIG. 5 and inequality (1) given below, the scanning signal Vs is set to be higher in voltage than the voltage (Vmax−Vturn-on) obtained by subtracting a turn-on voltage Vturn-on for the organic EL element OEL from the maximum voltage value (≈Vmax) applied to the signal line DL.

$$Vs(=Vsh)>V\text{max}-V\text{turn-on} \quad (1)$$

In this case, the set voltage Vset and the scanning signal Vs (=Vsh) having the relationship represented by inequality (1) are respectively applied to the anode electrode and cathode electrode of each organic EL element OEL connected to the scanning line of each row to produce a potential difference between the anode electrode and the cathode electrode. In the present invention, this potential difference causes no current to flow in any of the organic EL elements.

Owing to the application of each voltage in the set period Tset, therefore, before the driving current Ic (to be described later) is supplied (constant current supply period Tc), the interconnection capacitance added to the signal line DL and the junction capacitance of each organic EL element are quickly charged to a predetermined voltage (=Vset), and each organic EL element is held in the non-emission state.

(Constant Current Supply Period)

In the constant current supply period Tc, as shown in FIG. 4, after the low-level set control signal Vgs is applied to the gate terminal of the NMOS transistor Tr11 provided in the data driver 130 to turn off the transistor, the high-level current supply control signal Vgc is applied to the gate terminal of the NMOS transistor Tr12 to turn it on. At this time, the high-level reset control signal Vgr is applied to the gate terminal of the PMOS transistor Tr13 to keep it off. As a consequence, the driving current Ic having a constant current value is generated by the constant current supply circuit 133 and supplied to the signal line DL (the anode electrode of the organic EL element) through the NMOS transistor Tr12 (organic EL element supply current Iel=Ic).

In this case, the driving current Ic supplied from the data driver 130 to the organic EL element OEL through the signal line DL is set to be supplied with a predetermined signal time width (pulse width) corresponding to the luminance level based on display data supplied from the display signal generating circuit. The voltage Vc (e.g., 12 V) applied to the signal line DL by supplying the driving current Ic in the constant current supply period Tc is set to be equal to the set voltage Vset applied to the signal line DL in the set period Tset (signal line voltage Vdl=Vc=Vset).

In the constant current supply period Tc, the switch SWL provided in the scanning driver 120 is connected to the switching contact on the low-voltage power supply side, and the low-level scanning signal Vs (=Vsl) is applied to the scanning line SL (the cathode electrode of the organic EL element). In this case, the high-level scanning signal Vs (=Vsh) is kept applied to the scanning lines SL of the remaining rows in the unselected state. The low-level scanning signal Vs (=Vsl) is set to, for example, ground potential (0 V).

Owing to the application of the respective currents and voltages in the constant current supply period Tc, the predetermined driving current Ic required to perform light emission is supplied to each organic EL element connected to the selected scanning line at a predetermined signal time width (for a short period of time when the gray level is low, and vice versa) corresponding to display data on the basis of a known pulse width modulation (PWM driving) control method. As a consequence, each organic EL element emits light with a predetermined luminance level. In this case, since the interconnection capacitance added to the signal line DL and the junction capacitance of each organic EL element have been charged to the set voltage Vset (=Vc) in the set period Tset by the constant voltage source (the power supply for applying the set voltage Vset), the driving current Ic increases to the current value required for light emission in a very short period of time after the driving current Ic is supplied, and each organic EL element quickly emits light.

(Reset Period)

In the reset period Treset, as shown in FIG. 4, after the low-level current supply control signal Vgc is applied to the gate terminal of the NMOS transistor Tr12 provided in the data driver 130 to turn off the transistor, the low-level reset control signal Vgr is applied to the gate terminal of the PMOS transistor Tr13 to turn it on. At this time, the low-level set control signal Vgs is applied to the gate terminal of the NMOS transistor Tr11 to keep it off. As a consequence, the reset voltage Vreset having a predetermined low voltage (e.g., 6 V) is applied to the signal line DL (the anode electrode of the organic EL element) through the PMOS transistor Tr13, and the electric charge stored in the interconnection capacitance added to the signal line DL and the element capacitance of the organic EL element is discharged (signal line voltage Vdl=Vreset).

The reset voltage Vreset is set to an arbitrary potential that can temporarily release and reset the potential of the high voltage (Vset=Vc) applied to the signal line DL during the set period Tset and constant current supply period Tc described above and, for example, the reset voltage Vreset is set to ground potential (0 V). More preferably, as shown in FIG. 5, the reset voltage Vreset is set to be slightly lower than the turn-on voltage Vturn-on for the organic EL element (Vreset<Vturn-on). With this setting, when a row is repeatedly scanned and selected next, the time required for charging operation in the set period Tset is shortened, and the power consumption for charging/discharging operation is reduced as compared with a case wherein the reset voltage Vreset is set to ground potential (0 V).

In this manner, the above series of operation periods are set within a scanning period for each scanning line constituting the display panel, as shown in FIG. 6, thereby performing grayscale display of predetermined image information based on display data on the display panel.

As described above, in the display apparatus according to this embodiment, the set voltage Vset is applied from the constant voltage source to the signal line DL in a scanning period before the supply of the driving current Ic to charge the interconnection capacitance added to the signal line DL and the junction capacitance of the organic EL element in advance. This makes it possible to quickly perform charging/discharging operation in a short period of time as compared with a case wherein the capacitances are charged by using only a constant current source. In this case, the apparatus is resistant to the influence of a voltage drop due to the interconnection length of the signal line DL and the like, and can be charged to the substantially uniform set voltage Vset regardless of the layout positions of the scanning lines SL in the display panel 110.

In this case, the set voltage Vset is approximated at the voltage Vc that is set to supply a driving current to the organic EL element. Even if, therefore, the set period Tset switches to the constant current supply period Tc to supply the constant driving current Ic, the amount of adjustment of the signal line voltage Vd1 can be decreased. This makes it possible to shorten the time required for this adjustment and improve the response display characteristics.

In addition, owing to quick charging operation in the set period Tset, a relatively long operation time (constant current supply period Tc) can be ensured within a scanning period. Even if, therefore, the operation time (signal time width) of each organic EL element is controlled by the pulse width modulation control scheme, good grayscale display can be realized.

In the set period Tset, the potentials of all the scanning lines SL are set to the voltage Vsh having a predetermined high level. Even if, therefore, the set voltage Vset is applied to the signal line DL, no current flows in any organic EL element. This shortens the time required for precharging (charging) operation to the set voltage Vset, thereby improving the response characteristics.

Furthermore, in the constant current supply period Tc, supplying the driving current Ic having a constant current value from the constant current source can compensate for a voltage drop at the signal line DL so as to ensure the predetermined voltage Vc. This makes it possible to properly cope with a change in voltage applied to the organic EL element OEL over time and supply the constant current (driving current) Ic based on the substantially uniform voltage Vc to the organic EL element OEL, thereby realizing high display image quality without variations in luminance level.

In this case, since the pulse width modulation control scheme of supplying the driving current Ic having a constant current value with a time signal width (pulse width) corresponding to the luminance level component contained in display data is used for each organic EL element OEL, it suffices if the driving current Ic to be supplied to each organic EL element during the constant current supply period Tc has a constant current value. In addition, since there is no need to change/control the voltage value of the set voltage Vset, simple circuit arrangements can be used as a constant current source and constant voltage source which are used to supply the above current and voltage.

In the reset period Treset after the constant current supply period Tc, the voltage value of the reset voltage Vreset applied to the signal line DL need not be set to ground potential (0 V) but may be set to an arbitrary voltage equal to or less than the turn-on voltage Vturn-on for the organic EL element OEL. Therefore, the amount of electric charge to be charged/discharged with respect to the interconnection capacitance or the junction capacitance of the organic EL element OEL can be reduced by the potential difference (Vreset<Vturn-on). This makes it possible to reduce power consumption.

In the reset period Treset, the reset voltage Vreset is applied to the signal line DL instead of resetting all the scanning lines SL including unselected scanning lines every time the constant current supply period Tc (reset period) terminates. This eliminates the necessity to perform charging/discharging operation for the junction capacitance of the organic EL element OEL, thus reducing power consumption.

First Embodiment of Constant Current Supply Circuit

The first embodiment of a constant current supply circuit for outputting a driving current having a constant current value in the data driver according to the above embodiment will be described in detail with reference to the several views of the accompanying drawing.

Figure 7:
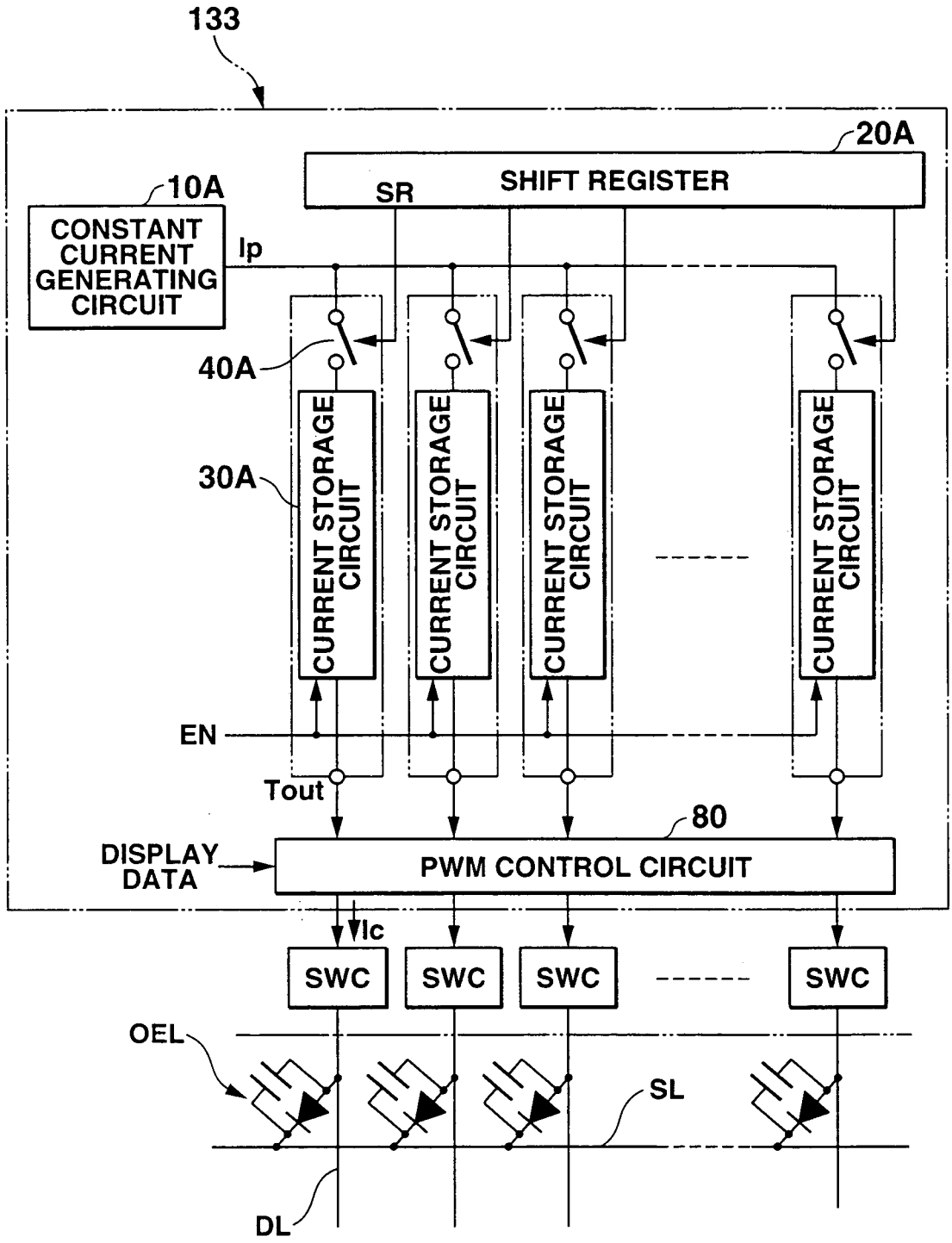
FIG. 7 is a schematic block diagram showing a first embodiment of a constant current supply circuit which can be applied to the driving apparatus according to the present invention.

FIG. 7 is a schematic block diagram showing a first embodiment of the constant current supply circuit which can be applied to the data driver according to the above embodiment.

As shown in FIG. 7, the constant current supply circuit 133 is comprised of a single constant current generating circuit 10A, a shift register 20A, a plurality of switch means 40A, a plurality of current storage circuits 30A, and a PWM control circuit 80. The constant current generating circuit 10A generates the driving current Ic for operating a plurality of loads (organic EL elements OEL). The shift register 20A sets timings at which the constant currents Ip supplied from the constant current generating circuit 10A are sequentially supplied to the current storage circuits 30A. The plurality of switch means 40A control the supply states of the constant currents Ip to the respective current storage circuits 30A in accordance with a switching signal (shift output) SR output from the shift register 20A at a predetermined timing. The plurality of current storage circuits 30A sequentially receive and hold (store) the constant currents Ip supplied from the constant current generating circuit 10A through the switch means 40A at predetermined timings based on the shift register 20A. The PWM control circuit 80 is connected to output terminals Tout, receives display data, and sets a signal time width (pulse width) with which the driving current Ic is to be supplied by PWM control based on the luminance level component contained in the display data.

In addition, "SWC" in FIG. 7 corresponds to the switch SWC in FIG. 2, and is a three-contact switch provided among an output terminal of the PWM control circuit 80, the set voltage Vset, the reset voltage Vreset, and the signal line DL connected to the plurality of organic EL elements OEL.

The arrangement of each of the above components will be described in detail below.

(Current Generating Circuit)

Figure 8:
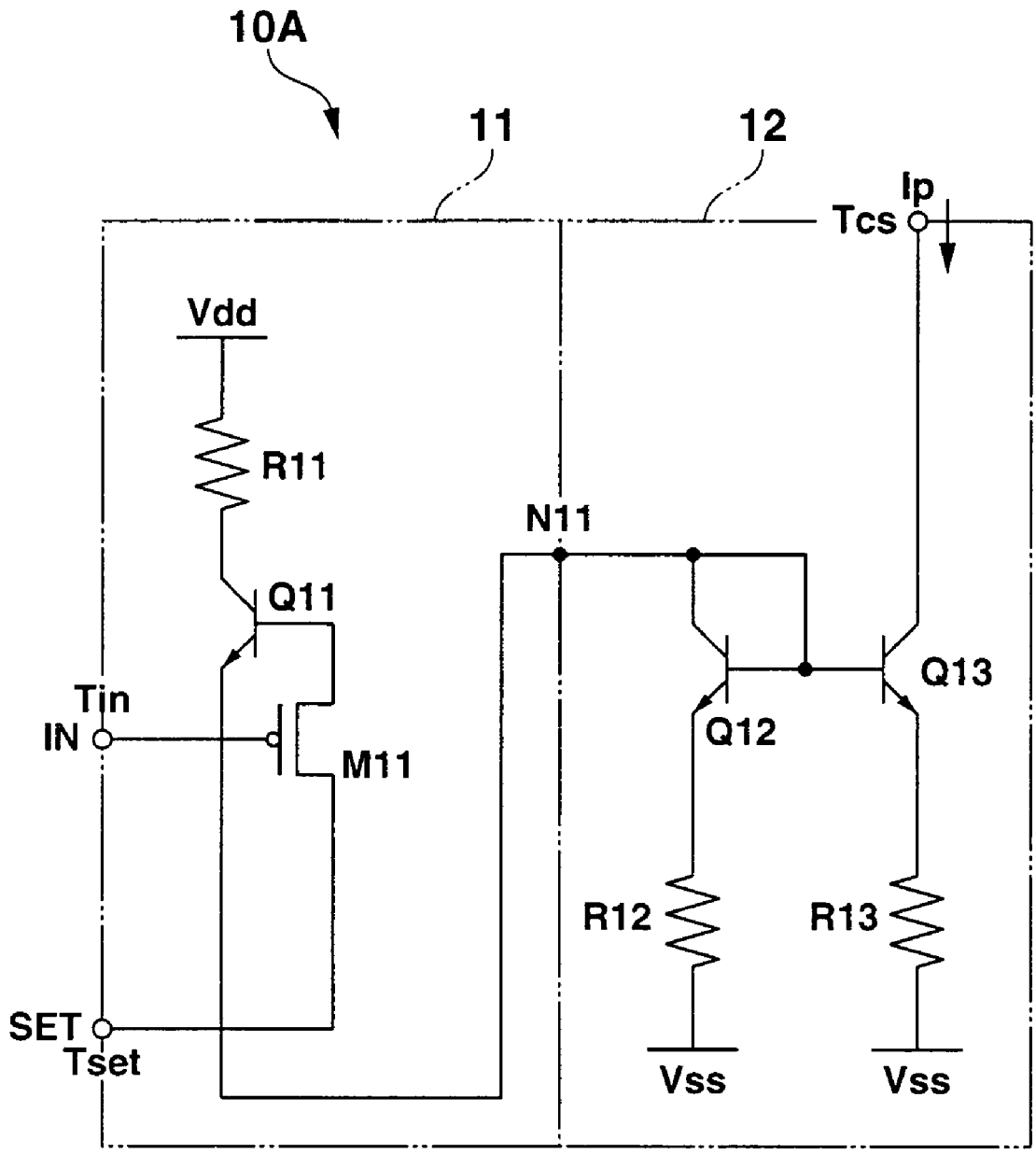
FIG. 8 is a circuit diagram showing a specific example of a current generating circuit which can be applied to the constant current supply circuit according to the present invention.

FIG. 8 is a circuit diagram showing the arrangement of a specific example of the current generating circuit which can be applied to the above constant current supply circuit or circuit 10A.

In brief, the constant current generating circuit 10A is designed to generate the constant current Ip having a current value required to make each of the organic EL elements operate in a predetermined emission state and output the current to each current storage circuit 30A provided in correspondence with a corresponding one of the organic EL elements.

In this case, the constant current generating circuit 10A can have a circuit arrangement including a control current generating circuit 11 on the front stage and an output current generating circuit 12 on the rear stage, as shown in, for example, FIG. 8. Note that the current generating circuit described in this embodiment is merely an example that can be applied to the driving device according to the present invention, and is not limited to this circuit arrangement. This embodiment exemplifies, as the constant current generating circuit 10A, the arrangement having the control current generating circuit 11 and output current generating circuit 12. However, the present invention is not limited to this. For example, a circuit having a circuit arrangement formed from only the control current generating circuit 11 may also be used.

For example, as shown in FIG. 8, the control current generating circuit 11 has a circuit arrangement including a pnp bipolar transistor (to be abbreviated as a "pnp transistor" hereinafter) Q11 and NMOS transistor M11. The pnp transistor has an emitter connected to the other terminal of a resistor R11 whose one terminal is connected to a high-potential power supply Vdd, and a collector connected to the rear-stage current mirror circuit section 12 (output node N11). The NMOS transistor M11 has a source connected to the base of the pnp transistor Q11, a drain connected to the set terminal Tset to which a set signal SET is input, and a gate connected to an input terminal Tin to which a predetermined control signal IN is input.

For example, as shown in FIG. 8, the output current generating circuit 12 has a circuit arrangement including an npn bipolar transistor (to be abbreviated as an "npn transistor" hereinafter) Q12, resistor R12, npn transistor Q13, and resistor R13. The npn transistor Q12 is formed from a current mirror circuit and has a collector and base which are connected to the output node N11 of the control current generating circuit 11. The resistor R12 is connected between the emitter of the npn transistor Q12 and a low-potential power supply Vss. The npn transistor Q13 has a collector connected to an output terminal Tcs which outputs an output current (constant current Ip) having a predetermined current component, and a base connected to the output node N11 of the control current generating circuit 11. The resistor R13 is connected between the emitter of the npn transistor Q13 and the low-potential power supply Vss.

In this case, an output current (constant current Ip) has a current value corresponding to a predetermined current ratio which is defined by the current mirror circuit arrangement with respect to the current value of a control current generated by the control current generating circuit 11 and input through the output node N11. In this embodiment, when an output current of negative polarity is supplied to the current storage circuit 30A, a current component flows from the current storage circuit 30A to the constant current generating circuit 10A.

(Shift Register/Switch Means)

The shift register 20A sequentially applies sequentially output shift outputs as switching signals SR to the respective switch means 40A provided in correspondence with the respective signal lines DL on the basis of control signals supplied from, for example, a control section such as the system controller 140 shown in FIG. 1. The switch means 40A are turned on at different timings on the basis of the switching signals SR output from the shift register 20A to supply the constant currents Ip from the constant current generating circuit 10A to the current storage circuits 30A so as to control them to receive and hold the currents.

(Current Storage Circuit)

Figure 9:
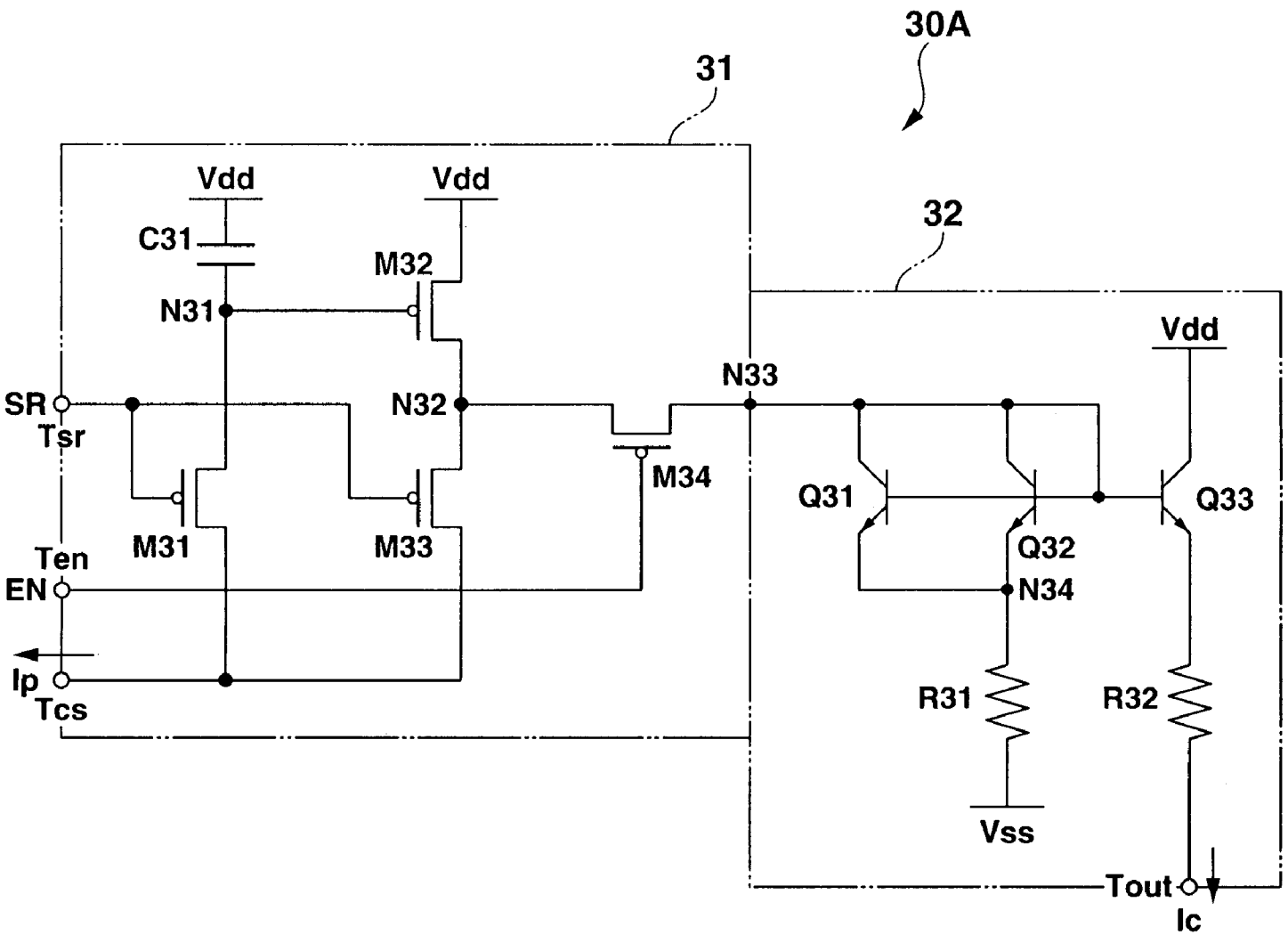
FIG. 9 is a circuit diagram showing a specific example of an arrangement constituted by a current storage circuit and switch means which can be applied to the constant current supply circuit according to the present invention.
Figure 10A:
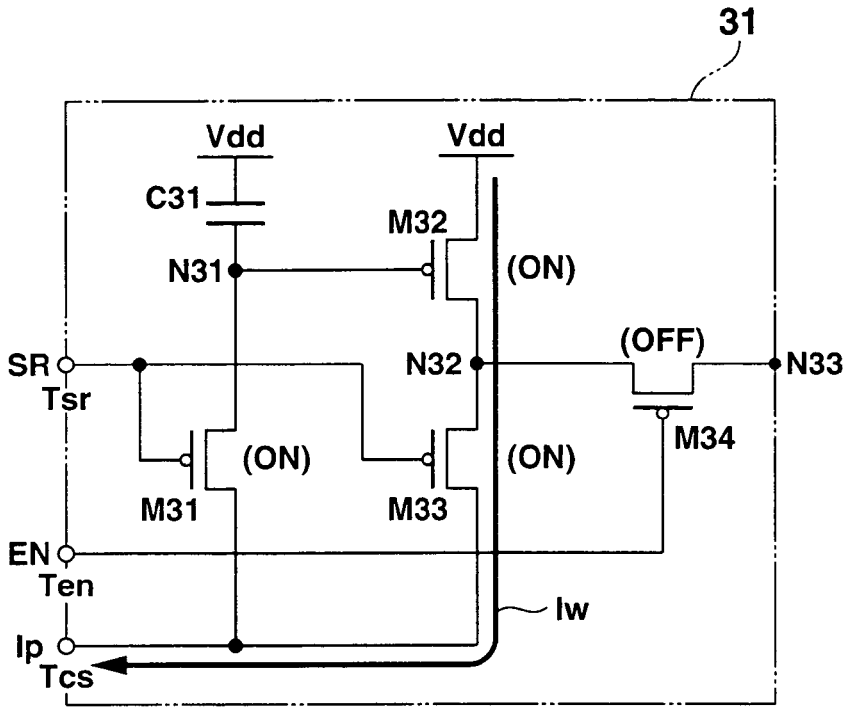
FIGS. 10A and 10B are circuit diagrams showing basic operation in a current storage circuit which can be applied to the constant current supply circuit according to the present invention.
Figure 10B:
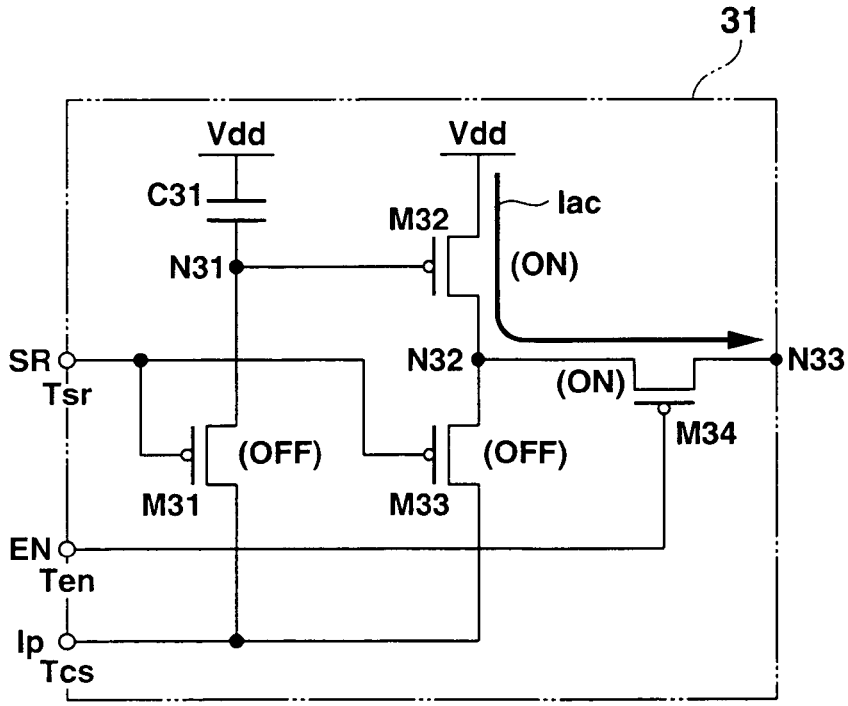

FIG. 9 is a circuit diagram showing an example of an arrangement including a current storage circuit and a switch means which can be applied to the above constant current supply circuit. FIGS. 10A and 10B are conceptual views showing the basic operation of a current storage circuit which can be applied to the above constant current supply circuit.

The current storage circuits 30A are designed to sequentially receive and hold the constant currents Ip output from the constant current generating circuit 10A on the basis of shift outputs output from the shift register 20A and simultaneously output the held current components directly or predetermined currents generated on the basis of the current components, as the driving currents Ic, to the respective signal lines DL through the output terminals Tout.

In this case, the current storage circuit 30A can have a circuit arrangement including a voltage component holding section 31 (including the switch means 40A) on the front stage and a driving current generating section 32 on the rear stage, as shown in, for example, FIG. 9. Note that the current storage circuit described in this embodiment is merely an example that can be applied to the driving device according to the present invention, and is not limited to this circuit arrangement. This embodiment exemplifies, as the current storage circuit 30A, the arrangement having the voltage component holding section 31 and driving current generating section 32. However, the present invention is not limited to this. For example, a circuit having a circuit arrangement formed from only the voltage component holding section 31 may also be used.

For example, as shown in FIG. 9, the voltage component holding section 31 has an arrangement including PMOS transistors M31, M32, and M33, storage capacitance C31, and PMOS transistor M34. The PMOS transistor M31 has a source and drain respectively connected to a node N31 and an output terminal Tcs of the constant current generating circuit 10A, and a gate connected to an shift output terminal Tsr of the shift register. The PMOS transistor M32 has a source and drain respectively connected to a high-potential power supply Vdd and a node N32, and a gate connected to the node N31. The PMOS transistor M33 has a source and drain respectively connected to the node N32 and the output terminal Tcs of the constant current generating circuit 10A, and a gate connected to the shift output terminal Tsr of the shift register 20A. The storage capacitance C31 is connected between the high-potential power supply Vdd and the node N31. The PMOS transistor M34 has a source and drain respectively connected to the node N32 and an output node N33 of the rear-stage driving current generating section 32, and a gate connected to an output control terminal Ten to which an output enable signal EN which is supplied from a control section such as the system controller 140 shown in FIG. 1 and controls the output state of a control current to the rear-stage driving current generating section 32 is input. In this case, the PMOS transistors M31 and M33 which are turned on/off on the basis of the switching signals (shift outputs) SR from the shift register 20A constitute the switch means 40A described above. The storage capacitance C31 provided between the high-potential power supply Vdd and the node N31 may be a parasitic capacitance formed between the gate and source of the PMOS transistor M32.

For example, as shown in FIG. 9, the driving current generating section 32 comprises a current mirror circuit and has an arrangement including npn transistors Q31, Q32, and Q33, and resistors R31 and R32. The npn transistors Q31 and Q32 have collectors and bases connected to the output node N33 of the voltage component holding section 31 described above, and emitters connected to a node N34. The resistor R31 is connected between the node N34 and a low-potential power supply Vss. The npn transistor Q33 has a collector connected to a high-potential power supply Vdd and a base connected to the output node N33 of the voltage component holding section 31 described above. The resistor R32 is connected between an emitter of the npn transistor Q33 and an output terminal Tout from which an output current (driving current Ic) is output.

In this case, the output current (driving current Ic) has a current value corresponding to a predetermined current ratio defined by the current mirror circuit arrangement with respect to the current value of a control current output from the voltage component holding section 31 and input through the output node N33.

Note that the above current ratio may be defined by changing the area ratios among the npn transistors Q31 to Q33 instead of using the resistors R31 and R32 which define the current ratio in the circuit arrangement of the current mirror circuit 32. In this case, variations in output current can be suppressed by suppressing the occurrence of variations in current component inside the circuit due to variations in the resistance values of the resistors R31 and R32.

In the basic operation of the current storage circuit (including the switch means) having the above arrangement, current holding operation and current supplying operation are executed at predetermined timings, in an operation cycle (scanning period) of the organic EL element, so as not to overlap temporally. Current holding operation and current supplying operation will be described in detail below.

(Current Holding Operation)

In current holding operation, first of all, the PMOS transistor M34 serving as an output control means is turned off by applying the high-level output enable signal EN from the control section (system controller 140) through the output control terminal Ten. In this state, the PMOS transistors M31 and M33 serving as input control means (switch means 40A) are turned on by supplying the current Ip having a current component of negative polarity from the constant current generating circuit 10A to the transistors through the input terminal Tcs (the output terminal Tcs of the constant current generating circuit 10A) and applying the low-level switching signal SR from the shift register 20A to the transistors through the shift output terminal Tsr at a predetermined timing.

With this operation, a low-level voltage corresponding to the current Ip of negative polarity is applied to the node N31 (i.e., the gate terminal of the PMOS transistor M32 or one terminal of the storage capacitance C31) to produce a potential difference between the high-potential power supply Vdd and the node N31 (between the gate and source of the PMOS transistor M32). As a consequence, the PMOS transistor M32 is turned on. As shown in FIG. 10A, then, a write current Iw equivalent to the current Ip flows from the high-potential power supply to the input terminal Tcs through the PMOS transistors M32 and M33.

At this time, electric charge corresponding to the potential difference produced between the high-potential power supply Vdd and the node N31 (between the gate and source of the PMOS transistor M32) is stored in the storage capacitance C31 and held as a voltage component. At the end of the current holding operation, the high-level switching signal SR is applied from the shift register 20A to the PMOS transistors M31 and M33 through the shift output terminal Tsr to turn of the transistors. As a consequence, the electric charge (voltage component) stored in the storage capacitance C31 is held even after the supply of the write current Iw is stopped.

(Current Supply Operation)

In driving operation after current holding operation, the low-level output enable signal EN is applied from the control section (system controller 140) to the PMOS transistor M34 through the output control terminal Ten to turn on the transistor. At this time, since a potential difference equivalent to that in current holding operation has been produced between the gate and source of the PMOS transistor M32 owing to the voltage component held in the storage capacitance C31, a driving control current Iac having a current value equivalent to the write current Iw (=current Ip) flows from the high-potential power supply to the output node N33 (current mirror circuit section 32) through the PMOS transistors M32 and M34, as shown in FIG. 10B.

The driving control current Iac made to flow to the current mirror circuit section 32 by this operation is converted into the driving current Ic having a current value corresponding to a predetermined current ratio defined by the current mirror circuit arrangement. This current is supplied to each signal line DL through a corresponding one of the output terminals Tout. At the end of the current supply operation, the high-level output enable signal EN is applied from the control section to the PMOS transistor M34 through the output control terminal Ten to turn off the transistor, thereby stopping the supply of the driving current Ic from the current storage circuit 30A to the signal line DL.

In the current driving device having the above arrangement and driving method, during a current holding operation period, the single constant current generating circuit 10A generates and outputs the constant current Ip having a predetermined current value, and the switching signals SR sequentially output from the shift register 20A are sequentially applied to the respective switch means 40A. With this operation, the respective switch means 40A are sequentially turned on at different timings, and the write currents Iw each corresponding to the constant current Ip output from the constant current generating circuit 10A sequentially flow to the respective current storage circuits 30A to be written and held as voltage components (the above current holding operation).

In a current supply operation period, after the constant currents Ip output from the single constant current generating circuit 10A are held in all the current storage circuits 30A, the output enable signal EN is commonly applied from the control section to the respective current storage circuit 30A at the same timing. With this operation, currents corresponding to the voltage components held in the respective current storage circuits 30A are simultaneously supplied to the respective signal lines through the output terminals Tout as the driving currents Ic each having a predetermined signal time width set by the PWM control section (not shown).

(Above Current Supply Operation)

A current holding operation period and current supply operation period like those described above are repeatedly set for each scanning period in which the respective scanning lines SL are sequentially selected by the scanning driver 120 shown in FIG. 1. This makes it possible to sequentially operate the organic EL elements on each row with a predetermined luminance level.

The data driver having the constant current supply circuit according to this embodiment sequentially repeats the following operation for each row: simultaneously supplying, to the organic EL elements connected to each scanning line SL arranged in the display apparatus 100 shown in FIG. 2, the driving currents Ic, each of which is formed from a constant current supplied from the signal current source (current generating circuit) and having a uniform current characteristic and has a signal time width corresponding to display data, through the respective signal lines DL during a scanning period for each scanning line SL, thereby making each organic EL element emit light with a predetermined luminance level. This allows each organic EL element to operate with uniform operation characteristics while suppressing variations in current value among the respective signal lines (among the respective semiconductor chips constituting the constant current supply circuit and among the output terminals of the semiconductor chips). Therefore, desired image information can be displayed with an excellent luminance level while the occurrence of display unevenness is suppressed.

Second Embodiment of Constant Current Supply Circuit

The second embodiment of the above constant current supply circuit will be described with reference to the views of the accompanying drawing.

Figure 11:
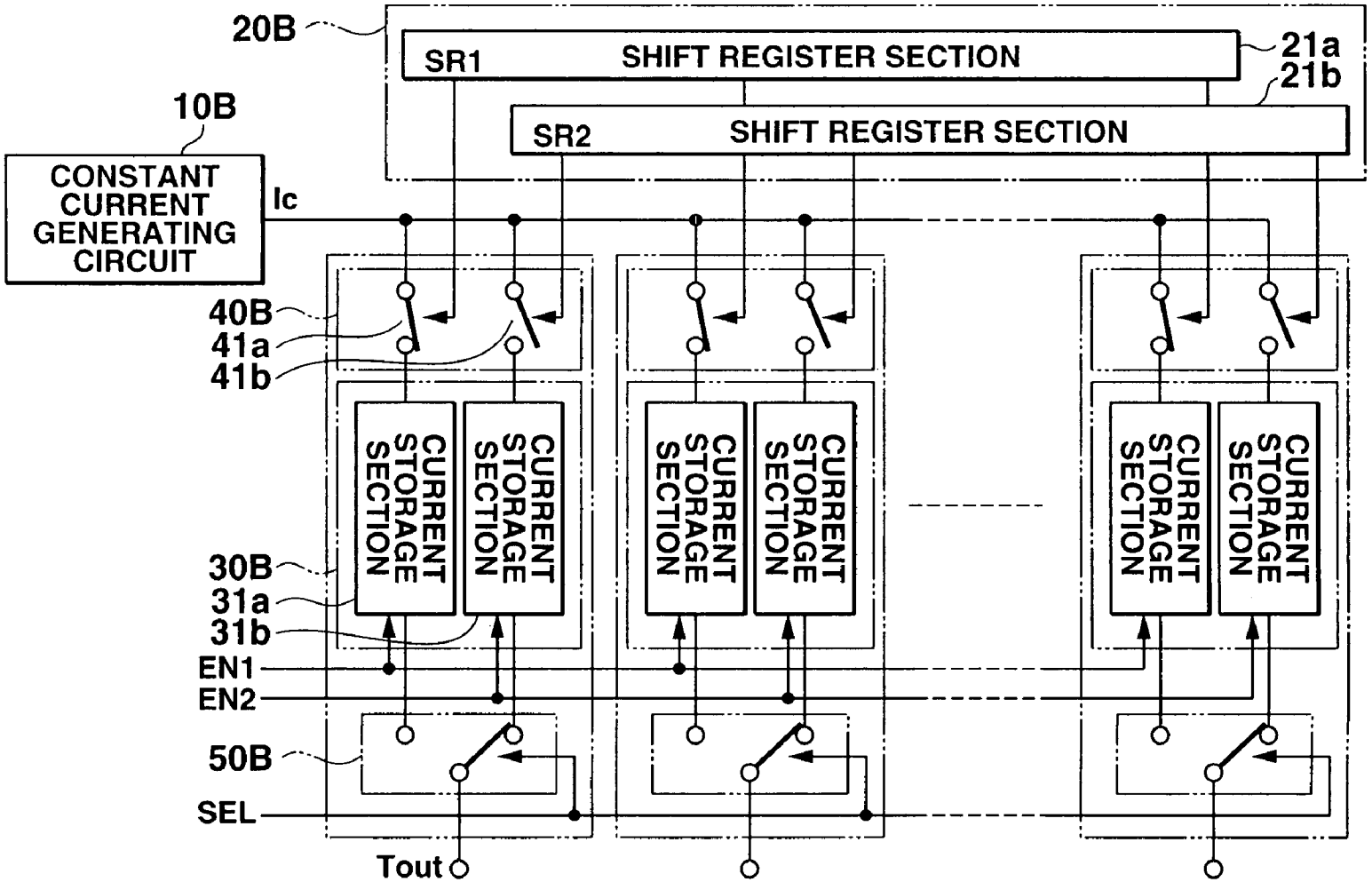
FIG. 11 is a schematic block diagram showing a second embodiment of the constant current supply circuit which can be applied to the driving device according to the present invention.

FIG. 11 is a schematic block diagram showing a second embodiment of the constant current supply circuit which can be applied to the above embodiment. The same reference numerals as in the above embodiment denote the same or similar parts in this embodiment, and a description thereof will be simplified or omitted.

As shown in FIG. 11, the constant current supply circuit according to this embodiment has a circuit arrangement including a single constant current generating circuit 10B which commonly supplies a constant current Ip, a plurality of current storage circuits 30B (current storage sections 31*a* and 31*b*) provided in correspondence with a predetermined number of output terminals Tout, a shift register 20B (shift register sections 21*a* and 21*b*), a plurality of input-side switch means 40B (switches 41*a* and 41*b*), and a plurality of output-side switch means 50B. This constant current supply circuit has a pair of current storage sections for each output terminal and is designed to concurrently execute the following operations: the operation of sequentially holding, in one current storage section of each current storage circuit, a constant current supplied from the signal current generating circuit, and the operation of simultaneously outputting, through a corresponding one of the output terminals, the current that has already been held in the other current storage section of each current storage circuit.

In the constant current supply circuit having the above arrangement, during the first operation period (the period during which the current storage sections 31*a* are set in the current holding state and the current storage sections 31*b* are set in the current supply state), switching signals SR1 from the shift register section 21*a* are sequentially output to the switches 41*a* provided in correspondence with the current storage sections 31*a* of the respective current storage circuits 30B. With this operation, the respective switches 41*a* are sequentially set in the ON state only for predetermined periods, and the currents Ip supplied from the constant current generating circuit 10B are sequentially written in the respective current storage sections 31*a*. At this time, no switching signal SR2 is output from the shift register section 21*b*, and all the switches 41*b* are in the OFF state. At this time, a control section commonly outputs, to the output-side switch means 50B provided in correspondence with the respective output terminals Tout, an output selection signal SEL for switching the output-side switch means 50B to the current storage section 31*b* side, and also outputs an output enable signal EN2 to all the current storage sections 31*b* at a predetermined timing, thereby simultaneously outputting the currents that have already been stored in the respective current storage sections 31*b* through the respective output terminals Tout.

In the second operation period (the period during which the current storage sections 31*a* are set in the current supply state and the current storage sections 31*b* are set in the current holding state) set after the first operation period terminates, the switching signals SR2 from the shift register section 21*b* are sequentially output to the switches 41*b* provided in correspondence with the current storage sections 31*a* of the respective current storage circuits 30B. With this operation, the respective switches 41*b* are sequentially set in the ON state only for predetermined periods, and the currents Ip supplied from the constant current generating circuit 10B are sequentially written in the respective current storage sections 31*b*. At this time, no switching signal SR1 is output from the shift register section 21*a*, and all the switches 41*a* are in the OFF state. At this time, the control section commonly outputs, to the output-side switch means 50B, the output selection signal SEL for switching the output-side switch means 50B to the current storage section 31*a* side, and also outputs output enable signal EN1 to all the current storage sections 31*a* at a predetermined timing, thereby simultaneously outputting the currents that have already been stored in the respective current storage sections 31*a* through the respective output terminals Tout.

Such first and second operation periods are repeatedly set in each predetermined operation cycle to alternately and consecutively execute the operation of holding, in one of each pair of current storage sections 31*a* and 31*b*, the current Ip continuously output from the constant current generating circuit 10B and the operation of outputting the current Ip from the other of each pair.

As in the first embodiment described above, the data driver having the constant current supply circuit according to this embodiment sequentially receives and holds, in the respective current storage circuits, currents output from the single constant current generating circuit, and simultaneously outputs the currents at a predetermined timing. This allows a current having a uniform current characteristic and supplied from the signal current source to be held for each output terminal, thus suppressing variations in driving current among the respective output terminals. In addition, a pair of current storage sections are provided for each output terminal so that while currents output from the current generating circuit are sequentially written in the current storage section on one side, the currents held in the current storage sections on the other side are simultaneously output. This makes it possible to shorten or eliminate the wait time for current write operation. As compared with the first embodiment, the supply time of a driving current to each load (each organic EL element) can be prolonged, and hence the driven state of each load can be controlled more finely. In addition, the time for current holding operation can be prolonged in each current storage circuit, and hence current holding operation can be stably performed in each current storage circuit.

Third Embodiment of Constant Current Supply Circuit

The third embodiment of the above constant current supply circuit will be described next with reference to the views of the accompanying drawing.

Figure 12:
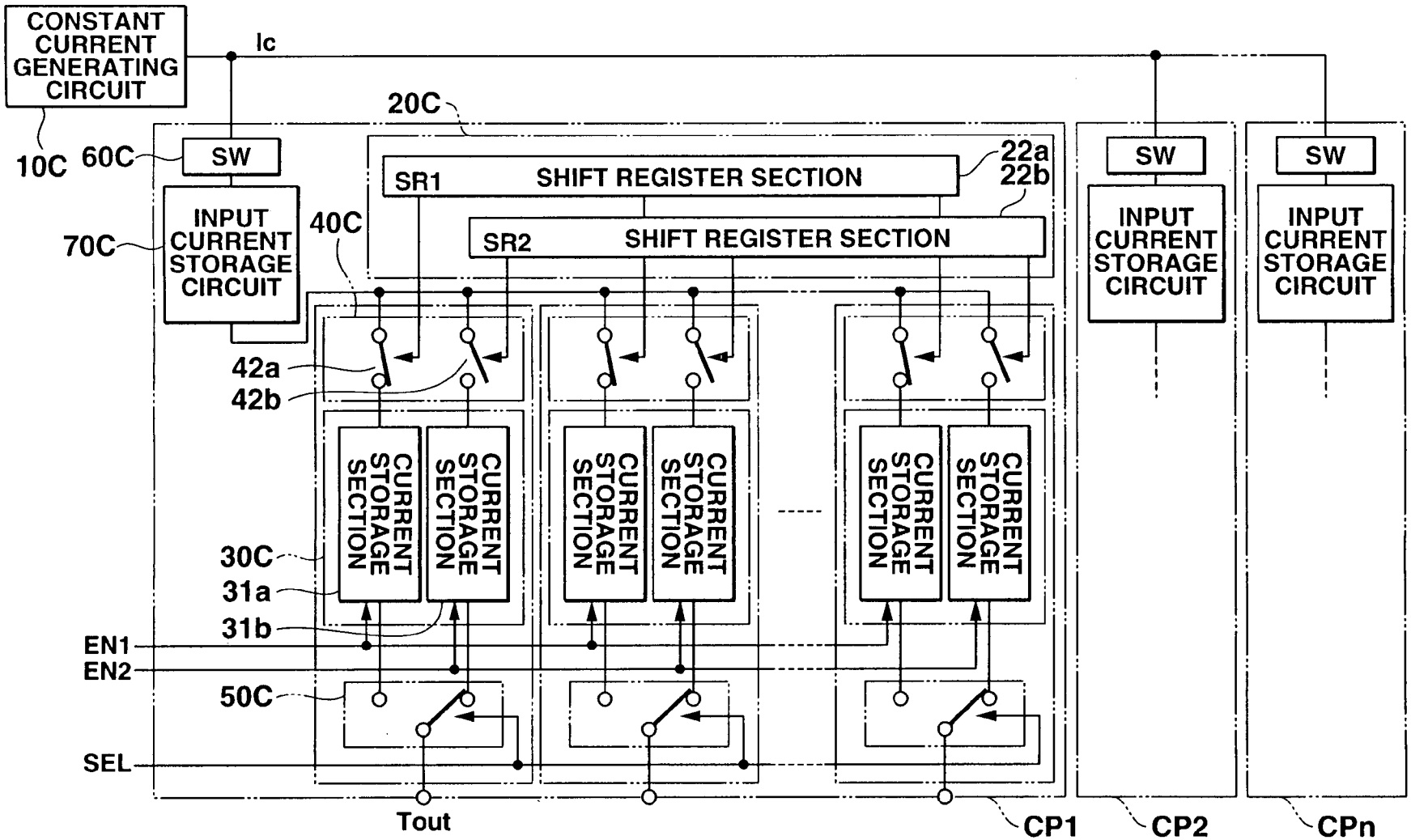
FIG. 12 is a schematic block diagram showing a third embodiment of the constant current supply circuit which can be applied to the driving device according to the present invention.

FIG. 12 is a schematic block diagram showing the third embodiment of the constant current supply circuit which can be applied to the above embodiments. The same reference numerals as in the above embodiments denote the same or similar parts in this embodiment, and a description thereof will be simplified or omitted.

As shown in FIG. 12, the constant current supply circuit according to this embodiment includes a plurality of semiconductor chips CP1, CP2, . . . , CPn and a single constant current generating circuit 10C which commonly supplies a constant current Ip to the respective semiconductor chips CP1, CP2, . . . , CPn. Each semiconductor chip has the following two circuit arrangements formed on the same semiconductor substrate: one circuit arrangement including a plurality of current storage circuits 30C (current storage sections 31*a* and 31*b*) provided in correspondence with a predetermined number of output terminals Tout, a shift register 20C (shift register sections 22*a* and 22*b*), a plurality of input-side switch means 40C (switches 42*a* and 42*b*), and a plurality of output-side switch means 50C; and the other circuit arrangement, provided at an input section to which the constant current Ip output from the constant current generating circuit 10C is supplied and which is located at the front stage of the above circuit arrangement, constituted by an input section switch means 60C which is turned on/off on the basis of a shift output from a shift register (not shown) and an input current storage circuit 70C which receives and holds the constant current Ip output from the constant current generating circuit 10C.

Note that the constant current generating circuit 10C., shift register 20C (shift register sections 22*a* and 22*b*), current storage circuit 30C (current storage sections 31*a* and 31*b*), and input-side switch means 40C (switches 42*a* and 42*b*) have almost the same arrangements as those in the above embodiment, and hence a detailed description thereof will be omitted.

In this case, the output-side switch means 50C selectively switches and controls the output states of currents held in the current storage sections 31*a* and 31*b* to the respective output terminals Tout (signal lines DL) by selecting one of the current storage sections 31*a* and 31*b* on the basis of a predetermined output selection signal SEL. The input section switch means 60C provided for the respective semiconductor chips CP1, CP2, . . . , CPn are turned on at different timings on the basis of shift outputs sequentially output from shift registers (or control sections) (not shown) to supply the constant currents Ip output from the constant current generating circuit 10C to the respective semiconductor chips CP1, CP2, . . . , CPn and make the input current storage circuits 70C to hold the currents.

Each input current storage circuit 70C has the same arrangement as that of the current storage circuit in the above embodiment (see FIG. 9). The input current storage circuits 70C sequentially receive and hold the currents Ip output from the constant current generating circuit 10C at predetermined timings at which the above input section switch means 60C are turned on, and output the held currents Ip to the current storage circuits 30C (the current storage sections 31*a* or current storage sections 31*b*) through the input-side switch means 40C (the switches 42*a* or switches 42*b*) in the respective semiconductor chips on the basis of an output enable signal output from a control section (system controller 140).

In the current driving device having the above arrangement, first of all, the constant current Ip having a predetermined current value and output from the constant current generating circuit 10C is commonly supplied to the semiconductor chips CP1, CP2, . . . , CPn, and is sequentially received and held in the input current storage circuits 70C through the input section switch means 60C provided for the respective semiconductor chips CP1, CP2, . . . , CPn at predetermined timings.

In the first operation period (the period during which the current storage sections 31*a* are set in the current holding state and the current storage sections 31*b* are set in the current supply state), switching signals SR1 from the shift register section 22*a* are sequentially output to the switches 42*a* provided in correspondence with the current storage sections 31*a* of the respective current storage circuits 30C. With this operation, the respective switches 42*a* are sequentially set in the ON state only for predetermined periods, and the current held in the input current storage circuit 70C is transferred to the current storage sections 31*a* to be held therein. At this time, no switching signal SR2 is output from the shift register 22*b*, and all the switches 42*b* are in the OFF state. At this time, the control section commonly outputs, to the output-side switch means SOC provided in correspondence with the respective output terminals Tout, an output selection signal SEL for switching the output-side switch means SOC to the current storage section 31*b* side, and also outputs an output enable signal EN2 to all the current storage sections 31*b* at a predetermined timing, thereby simultaneously outputting the currents that have already been stored in the respective current storage sections 31*b* through the respective output terminals Tout. These operations are concurrently performed in the respective semiconductor chips CP1, CP2, . . . , CPn.

The constant current Ip output from the constant current generating circuit 10C again at a predetermined timing after the end of the first operation period is sequentially received and held in the input current storage circuits 70C through the input section switch means 60C provided for the respective semiconductor chips CP1, CP2, . . . , CPn at predetermined timings.

In the second operation period (the period during which the current storage sections 31*a* are set in the current supply state and the current storage sections 31*b* are set in the current holding state) after the end of the first operation period, which is set after the constant current Ip is completely received and held in each input current storage circuit 70C, the switching signals SR2 from the shift register section 22*a* are sequentially output to the switches 42*b* provided in correspondence with the current storage sections 31*b* of the respective current storage circuits 30C. With this operation, the respective switches 42*b* are sequentially set in the ON state only for predetermined periods, and the current held in the input current storage circuit 70C is transferred to the current storage sections 31*b* to be held therein as in the first operation period described above. At this time, no switching signal SR1 is output from the shift register 22*a*, and all the switches 42*a* are in the OFF state. At this time, the control section commonly outputs, to the output-side switch means SOC, the output selection signal SEL for switching the output-side switch means 50C to the current storage section 31*a* side, and also outputs the output enable signal EN1 to all the current storage sections 31*a* at a predetermined timing, thereby simultaneously outputting the currents that have already been stored in the respective current storage sections 31*a* during the first operation period through the respective output terminals Tout. These operations are concurrently performed in the respective semiconductor chips CP1, CP2, . . . , CPn.

Such a series of operation periods are repeatedly set in each predetermined operation cycle to sequentially hold the constant currents Ip output from the constant current generating circuit 10C in the input current storage circuits 70C at the input sections of the respective semiconductor chips CP1, CP2, . . . , CPn and concurrently transfer, in the respective semiconductor chips, the currents to the current storage circuits 30C on the rear stage. In addition, the above setting makes it possible to alternately and consecutively execute the operation of holding the constant current Ip in one current storage section of each current storage circuit 30C and the operation of simultaneously outputting the current held in the other current storage section of each current storage circuit, as a driving current Ic, to each output terminal Tout.

In the arrangement of the constant current supply circuit according to this embodiment, even in a case wherein the number of signal lines arranged in a display panel like the one shown in FIG. 2 increases, and the signal lines are formed into groups each constituted by a predetermined number of lines so as to be driven by a plurality of semiconductor chips (driver chips), since a current output from a single current generating circuit can be commonly supplied to each semiconductor chip, variations in driving current among all the signal lines across the plurality of semiconductor chips can be suppressed. In addition, since the operation of sequentially supplying a current to an input current storage circuit provided for each semiconductor chip and then supplying the current to each current storage circuit in each semiconductor chip can be concurrently performed in the respective semiconductor chips, predetermined driving currents can be held in the current storage circuits corresponding to all the signal lines in substantially only the time required to write the current in each semiconductor chip (input current storage circuit). This makes it possible to greatly shorten the time required to hold this driving current. Therefore, the supply time of a driving current can be prolonged, and hence a driven state can be finely controlled. In addition, this arrangement can properly cope with an increase in the area of the screen of a display panel or an increase in resolution.

As described above, the driving device according to the present invention, which drives a plurality of current-driven optical elements, can increase the response speed of each optical element by applying a predetermined charge voltage to an interconnection capacitance and the element capacitance of the optical element so as to charge them before supplying a driving current to the optical element. Even if the driving current supplied to the optical element has a relatively small value, the element can be properly driven. In a display apparatus which uses this driving device to drive a display panel having a plurality of current-driven display elements, the charge voltage to be applied to each display element is set to a voltage determined with reference to the average value of voltages to be applied to the respective display elements connected to the data lines of the display panel using a driving current. This increases the response speed throughout the display elements in the entire display panel area, thus obtaining good display quality in accordance with a display gray level. In addition, the voltage to be applied to a data line after supply of a driving current is set to a voltage higher than ground potential and equal to or less than the threshold voltage of each display element. This setting makes it possible to reduce the corresponding potential difference and the amount of electric charge stored in the interconnection capacitance or the element capacitance, thereby reducing power consumption associated with supply of a driving current to each display element.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A driving device which supplies a current to a plurality of current driven optical elements to drive the optical elements, comprising:

a driving current supply circuit which supplies a driving current to each of the optical elements for a predetermined period; and a control voltage applying circuit which applies at least a charge voltage having a voltage value corresponding to a voltage to be applied to each of the optical elements using the driving current, before the driving current is supplied, wherein the driving current supply circuit comprises:

a single constant current generating circuit which outputs a constant current having a predetermined current value; and a plurality of current storage circuits which sequentially receive and hold the constant current and output the driving current based on the constant current.

2. A driving device according to claim 1, wherein the driving current supplied to each of the optical elements has a same current value with respect to each of the optical elements.

3. A driving device according to claim 1, wherein the predetermined current value of the constant current is equal to a current value of the driving current.

4. A driving device according to claim 1, wherein the single constant current generating circuit comprises:

a control current generating circuit which generates a control current having a predetermined current value; and an output current generating circuit which generates an output current having a predetermined current ratio with respect to the control current, and which outputs the output current as the constant current.

5. A driving device according to claim 4, wherein the output current generating circuit comprises a current mirror circuit which defines the predetermined current ratio.

6. A driving device according to claim 1, wherein:

each of the current storage circuits comprises a pair of current storage sections arranged in parallel, and the driving device further comprises a control section which, for each of the current storage circuits, alternately performs: (i) an operation of causing a first one of the current storage sections to receive the constant current output from the constant current generating circuit and hold a voltage component corresponding to the current value of the constant current, and concurrently performing an operation of causing a second one of the current storage sections to output the driving current based on a voltage component held in the second current storage section; and (ii) an operation of causing the second one of the current storage sections to receive the constant current output from the constant current generating circuit and hold the voltage component corresponding to the current value of the constant current, and concurrently performing an operation of causing the first one of the current storage sections to output the driving current based on the voltage component held in the first current storage section.

7. A driving device according to claim 1, wherein each of the current storage circuits comprises a voltage component holding section which receives the constant current output from the constant current generating circuit and holds a voltage component corresponding to the current value of the constant current.

8. A driving device according to claim 7, wherein the voltage component holding section comprises a capacitance element in which electric charge corresponding to the constant current is written.

9. A driving device according to claim 8, wherein:

the voltage component holding section includes a field effect transistor which causes the constant current to flow between a source and a drain thereof, and the capacitance element includes at least a parasitic capacitance between the source and a gate of the field effect transistor, in which a voltage applied between the source and gate of the field effect transistor and corresponding to the constant current is written.

10. A driving device according to claim 1, wherein the driving current supply circuit includes a plurality of chips, each of which includes a plurality of the current storage circuits, and wherein each of the plurality of chips comprises a single input current storage circuit which: is provided between the constant current generating circuit and said plurality of current storage circuits, receives the constant current output from the constant current generating circuit, holds a voltage component corresponding to the current value of the constant current, and supplies a current based on the voltage component to said plurality of current storage circuits.

11. A driving device according to claim 10, wherein the input current storage circuit comprises a capacitance element in which electric charges corresponding to the constant current are written as the voltage component.

12. A driving device according to claim 11, wherein:

the input current storage circuit comprises a field effect transistor which causes the constant current to flow between a source and a drain thereof, and the capacitance element includes at least a parasitic capacitance between the source and a gate of the field effect transistor, in which a voltage applied between the source and gate of the field effect transistor and corresponding to the constant current is written.

13. A driving device according to claim 1, wherein the control voltage applying circuit comprises means for applying a discharge voltage having a voltage value for causing each of said optical elements to perform a discharging operation, after the driving current is supplied.

14. A driving device according to claim 1, further comprising a pulse width control circuit which controls a pulse width of the driving current to be applied to each of said optical elements.

15. A driving device according to claim 14, wherein the pulse width control circuit controls the pulse width of the driving current in accordance with a luminance level component of a display signal.

16. A display apparatus which displays image information by supplying a driving current corresponding to a display signal to each of a plurality of current driven display elements comprising:

a display panel including a plurality of signal lines and a plurality of scanning lines intersecting at right angles, said plurality of display elements being respectively arranged near intersections of the signal lines and the scanning lines;

a scanning control circuit which sequentially scans the scanning lines to sequentially set the display elements connected to the respective scanning lines in a selected state; and a signal control circuit including at least a driving current supply circuit which supplies a respective driving current to each of said signal lines for a predetermined period, and a control voltage applying circuit which applies to each of said signal lines a charge voltage having a voltage value based on a voltage applied to each of said display elements upon application of the driving current, before supply of the driving current, wherein the driving current supply circuit in the signal control circuit comprises:

a single constant current generating circuit which outputs a constant current having a predetermined current value; and a plurality of current storage circuits which are provided in correspondence with said plurality of signal lines, which sequentially receive and hold the constant current, and which simultaneously output the driving currents to said plurality of signal lines based on the constant current.

17. A display apparatus according to claim 16, wherein the respective driving currents supplied to each of said signal lines of the display panel have a same current value for each of said signal lines.

18. A display apparatus according to claim 16, wherein the signal control circuit comprises a control section which performs supply of the driving currents by the driving current supply circuit and application of the charge voltages by the control voltage applying circuit in accordance with a timing at which the scanning control circuit sets the display elements in a selected state.

19. A display apparatus according to claim 16, wherein the voltage value of the charge voltage is higher than a threshold voltage for each of said display elements of the display panel and smaller than a maximum value of a voltage value applied to each of said display elements when the driving current is supplied to each of said display elements through said signal lines.

20. A display apparatus according to claim 19, wherein the voltage value of the charge voltage is equal to an average value of voltage values applied to the respective display elements when the driving current is supplied to the respective display elements through the respective signal lines.

21. A display apparatus according to claim 16, wherein the display elements comprise optical elements.

22. A display apparatus according to claim 21, wherein each of the optical elements comprises an organic electroluminescence element, which has an anode electrode connected to one of the signal lines, and a cathode electrode connected to one of the scanning lines.

23. A display apparatus according to claim 16, wherein the current value of the constant current is equal to a current value of the driving current.

24. display apparatus according to claim 16, wherein the constant current generating circuit comprises:

a control current generating circuit which generates a control current having a predetermined current value; and an output current generating circuit which generates an output current having a predetermined current ratio with respect to the control current, and which outputs the output current as the constant current.

25. A display apparatus according to claim 24, wherein the output current generating circuit comprises a current mirror circuit which defines the predetermined current ratio.

26. A display apparatus according to claim 16, wherein:

each of said current storage circuits comprises a pair of current storage sections arranged in parallel, and the driving device further comprises a control section which, for each of the current storage circuits, alternately performs: (i) an operation of causing a first one of the current storage sections to receive the constant current output from the constant current generating circuit and hold a voltage component corresponding to the current value of the constant current, and concurrently performing an operation of causing a second one of the current storage sections to output the driving current based on a voltage component held in the second current storage section; and (ii) an operation of causing the second one of the current storage sections to receive the constant current output from the constant current generating circuit and hold the voltage component corresponding to the current value of the constant current, and concurrently performing an operation of causing the first one of the current storage sections to output the driving current based on the voltage component held in the first current storage section.

27. A display apparatus according to claim 16, wherein each of the current storage circuits comprises a voltage component holding section which receives the constant current output from the constant current generating circuit and holds a voltage component corresponding to the current value of the constant current.

28. A display apparatus according to claim 27, wherein the voltage component holding section comprises a capacitance element in which electric charge corresponding to the constant current is written.

29. A display apparatus according to claim 28, wherein:

the voltage component holding section comprises a field effect transistor which causes the constant current to flow between a source and a drain thereof, and the capacitance element includes at least a parasitic capacitance between the source and a gate of the field effect transistor, in which a voltage applied between the source and gate of the field effect transistor and corresponding to the constant current is written.

30. A display apparatus according to claim 16, wherein the driving current supply circuit includes a plurality of chips, each of which includes a plurality of the current storage circuits, and wherein each of the plurality of chips comprises a single input current storage circuit which: is provided between the constant current generating circuit and said plurality of current storage circuits, receives the constant current output from the constant current generating circuit, holds a voltage component corresponding to the current value of the constant current, and supplies a current based on the voltage component to said plurality of current storage circuits.

31. A display apparatus according to claim 30, wherein the input current storage circuit comprises a capacitance element in which electric charges corresponding to the constant current are written as the voltage component.

32. A display apparatus according to claim 31, wherein:

the input current storage circuit comprises a field effect transistor which causes the constant current to flow between a source and a drain thereof, and the capacitance element includes at least a parasitic capacitance between the source and a gate of the field effect transistor, in which a voltage applied between the source and gate of the field effect transistor and corresponding to the constant current is written.

33. A display apparatus according to claim 16, wherein the plurality of current storage circuits in the signal control circuit are formed on at least one semiconductor chip.

34. A display apparatus according to claim 33, wherein the constant current generating circuit is formed on a semiconductor chip different from the at least one semiconductor chip on which the plurality of current storage circuits are formed.

35. A display apparatus according to claim 33, wherein the constant current generating circuit is formed on a same semiconductor chip as the plurality of current storage circuits.

36. A display apparatus according to claim 16, wherein the control voltage applying circuit in the signal control circuit comprises means for applying, to each of said signal lines, a discharge voltage having a voltage value that causes each of said display elements to perform a discharging operation, after the driving current is supplied to each of said signal lines.

37. A display apparatus according to claim 36, wherein the voltage value of the discharge voltage does not exceed a threshold voltage of the display elements.

38. A display apparatus according to claim 16, wherein the signal control circuit further comprises a pulse width control circuit which controls a pulse width of the driving current applied to each of said signal lines.

39. A display apparatus according to claim 38, wherein the pulse width control circuit controls the pulse width of the driving current in accordance with a luminance level component of a display signal.

40. A display apparatus according to claim 16, further comprising means for inhibiting a current from flowing in the display elements when the charge voltage is applied from the control voltage applying circuit in the signal control circuit to the display elements.

41. A display apparatus according to claim 16, wherein the scanning control circuit comprises means for applying, to all of the scanning lines, a charge control voltage having a voltage value which inhibits a current from flowing in the display elements, during a period in which the charge voltage is applied from the control voltage applying circuit in the signal control circuit to each of said signal lines.

42. A display apparatus according to claim 41, wherein the voltage value of the charge control voltage is higher than a voltage obtained by subtracting a threshold voltage of the display elements from the charge voltage.

43. A display apparatus according to claim 16, wherein the scanning control circuit comprises means for sequentially applying to each of the scanning lines, a driving control voltage having a voltage value which causes the driving current to flow in the display element, wherein during each time said driving control voltage is applied, the driving current is supplied from the driving current supply circuit of the signal control circuit to each of said signal lines.

44. A display apparatus according to claim 43, wherein the driving control voltage is set to ground potential.

45. A driving method for a driving device which supplies a current to a plurality of current driven optical elements to drive the optical elements, comprising:

supplying a driving current to each of said optical elements for a predetermined period; and applying a charge voltage having a voltage value based on a voltage to be applied to each of said optical elements by application of the driving current, before the driving current is supplied, wherein supplying the driving current comprises:

generating a constant current having a predetermined current value using a single constant current generating circuit, and outputting the constant current to a plurality of current storage circuits;

sequentially receiving and holding the constant current in each of the current storage circuits; and applying the driving current from each of the current storage circuits to the optical elements based on the constant current held in each of the current storage circuits.

46. A driving method for a driving device according to claim 45, further comprising applying, to the optical elements, a discharge voltage having a voltage value which causes each of said optical elements to perform a discharging operation, after the driving current is supplied.

47. A driving method for a driving device according to claim 45, wherein said holding the driving current in each of said current storage circuits and said applying the driving current to said optical elements are concurrently executed.

48. A driving method for a driving device according to claim 45, wherein a plurality of chips are provided, each of which includes a plurality of the current storage circuits, and the outputting the constant current to each of said current storage circuits comprises, for each of the plurality of chips:

receiving and holding, in a single input current storage circuit, a voltage component corresponding to the current value of the constant current output from the constant current generating circuit; and supplying, to said plurality of current storage circuits, a current based on the voltage component held in the input current storage circuit.

49. A driving device for a display panel, wherein the display panel includes: (i) a plurality of scanning lines extending in a row direction, (ii) a plurality of signal lines extending in a column direction which intersect the scanning lines, and (iii) a plurality of current-driven optical elements, each of which is positioned at a respective intersection of one of the scanning lines with one of the signal lines, with a first end of the current-driven optical element connected to the scanning line at the intersection and a second end of the current-driven optical element connected the signal line at the intersection, said driving device comprising:

a driving current supply circuit which supplies respective driving currents through the signal lines for respective predetermined periods during a period in which a potential of a given one of the scanning lines is set such that the driving currents flow through the optical elements connected to the given scanning line, to drive the optical elements connected to the given scanning line; and a control voltage applying circuit which, before the driving currents corresponding to the given scanning line are supplied and during a period in which the potential of the scanning lines is set such that no drive current flows through the optical elements, applies a charge voltage to the optical elements, said charge voltage having a voltage value corresponding to a voltage to be applied to each of the optical elements using the driving currents.

50. A display device for displaying image information via a plurality of current-driven display elements, said display device comprising:

a display panel, which includes: (i) a plurality of scanning lines extending in a row direction, (ii) a plurality of signal lines extending in a column direction which intersect the scanning lines, and (iii) the plurality of current-driven display elements, each of which is positioned at a respective intersection of one of the scanning lines with one of the signal lines, with a first end of the display element connected to the scanning line at the intersection and a second end of the display element connected the signal line at the intersection;

a scanning control circuit which sequentially scans the scanning lines to sequentially set a potential of each one of the scanning lines to a given potential to set the optical elements connected to the one of the scanning lines in a selected state;

a driving current supply circuit which supplies respective driving currents through the signal lines for respective predetermined periods during a period in which the optical elements of a given scanning line are set in the selected state, to drive the optical elements set in the selected state, wherein said given potential is a potential such that the driving currents flow through the optical elements set in the selected state; and a control voltage applying circuit which, before the driving currents corresponding to the given scanning line are supplied and during a period in which the potential of the scanning lines is set such that no drive current flows through the optical elements, applies a charge voltage to the optical elements, said charge voltage having a voltage value corresponding to a voltage to be applied to each of the optical elements using the driving currents.

51. A driving method for a driving device for a display panel, wherein the display panel includes: (i) a plurality of scanning lines extending in a row direction, (ii) a plurality of signal lines extending in a column direction which intersect the scanning lines, and (iii) a plurality of current-driven optical elements, each of which is positioned at a respective intersection of one of the scanning lines with one of the signal lines, with a first end of the current-driven optical element connected to the scanning line at the intersection and a second end of the current-driven optical element connected the signal line at the intersection, said driving method comprising:

supplying respective driving currents from the driving device through the signal lines for respective predetermined periods during a period in which a potential of a given one of the scanning lines is set such that the driving currents flow through the optical elements connected to the given scanning line, to drive the optical elements connected to the given scanning line; and applying a charge voltage to the optical elements, before the driving currents corresponding to the given scanning line are supplied and during a period in which the potential of the scanning lines is set such that no drive current flows through the optical elements, said charge voltage having a voltage value corresponding to a voltage to be applied to each of the optical elements using the driving currents.

* * * * *